US006074035A

United States Patent [19]

Irizawa et al.

[11] Patent Number: 6,074,035

[45] **Date of Patent: *Jun. 13, 2000**

[54] PRINTING APPARATUS

[75] Inventors: Takeshi Irizawa, Oizumi-machi; Yasushi Miura, Kawasaki; Toshihiro Sugikubo, Tokyo, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/626,316

[22] Filed: Apr. 2, 1996

[30] Foreign Application Priority Data

Apr. 3, 1995 [JP] Japan ..... 7-077729
Apr. 7, 1995 [JP] Japan ..... 7-082891

[51] Int. Cl.[7] ..... B41J 29/377

[52] U.S. Cl. ..... 347/18

[58] Field of Search ..... 347/14, 17, 18, 347/65; 400/124.13, 719

[56] References Cited

U.S. PATENT DOCUMENTS

| | | | |
|---|---|---|---|
| 5,017,941 | 5/1991 | Drake | 347/18 |
| 5,291,215 | 3/1994 | Nozawa et al. | 347/18 |
| 5,374,944 | 12/1994 | Janosky et al. | 347/223 |
| 5,402,160 | 3/1995 | Kadowaki et al. | 347/67 |
| 5,631,676 | 5/1997 | Karz | 347/18 |

FOREIGN PATENT DOCUMENTS

| | | |
|---|---|---|
| 0 450 641 | 10/1991 | European Pat. Off. . |
| 0 629 508 | 12/1994 | European Pat. Off. . |
| 0 700 790 | 3/1996 | European Pat. Off. . |
| 61-211045 | 9/1986 | Japan . |
| 1-242257 | 9/1989 | Japan . |
| 4047948 | 2/1992 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

A printing apparatus has a printing head which is subjected to environmental temperature variation and generates a large amount of heat. Stable ejection of a printing liquid can be constantly performed by temperature control of the printing head. The printing apparatus having the printing head therein includes a fluid passage provided in contact with the head, a fluid supply device for supplying a fluid to the fluid passage, and a heater for controlling temperature of the supplied fluid to maintain the temperature of the fluid within a predetermined range. The printing head is provided with a water tube for cooling water, which water tube gradually varies its cross sectional area. By this, flow velocity of the cooling water is gradually increased on the upstream side and maintained to have a large constant flow velocity on the downstream side.

25 Claims, 22 Drawing Sheets

PRINTING APPARATUS

BACKGROUND OF THE INVENTION

1. Field of the Invention

The present invention relates generally to a printing apparatus. More specifically, the invention relates to a printing apparatus performing a temperature control by employing a fluid.

2. Description of the Related Art

In a printing apparatus, temperature control of a printing head is important for improving printing quality. For example, in a printing head of an ink-jet system, when a head temperature or an ink temperature therein is varied associating with progress of printing operation, an ink ejection amount is also varied depending upon the temperatures. As a result, it may happen that printing is performed with different densities during printing operation. On the other hand, in the case of a thermal transfer type printing head, an ink amount to be transferred is varied associated with temperature variation. Thus, similarly, printing with different densities is performed.

On the other hand, as another example of lowering of printing quality, when a printing head has a plurality of printing elements, it is possible to cause non-uniformity of printing density even by non-uniformity of temperature to be caused between the printing elements. For example, in the case of a printing head of the ink-jet type, an ink amount to be ejected through ink ejection opening forming the printing element is differentiated between respective of individual ejection openings due to non-uniformity of the ink temperature. As a result, it is possible to cause density fluctuation and so forth on printed image or so forth. The non-uniformity of temperature to be caused between a plurality of printing elements tends to be relatively significant in so-called elongated head.

FIG. 14 is an illustration showing one example of a temperature distribution caused in an elongated head.

The shown head 1100 is an ink-jet type ejecting ink by utilizing thermal energy, which causes the distribution of temperature to have higher temperature at the center portion along the aligning direction of ejection openings 1101. The reason is that the ejection openings located at the longitudinal ends may have higher heat radiation effect.

In order to restrict lowering of printing quality due to distribution of the head temperature, there have been known various conventional constructions for controlling head temperature.

For example, it has been known to provide a sub-heater in addition to heaters for generating thermal energy to be utilized for ink ejection in an ink-jet head and to control driving of the sub-heater to adjust the head temperature (see Japanese Patent Application Laid-open No. 211045/1986). However, such construction for head temperature control is employed in a printer employing a head having the relatively small number of ejection openings, in general.

Contrary to this, in an industrial printing apparatus, such as an ink-jet textile printing apparatus and so forth obtaining a printing cloth and so forth by ejecting ink onto a cloth, for example, it is typical to employ an elongated head as set forth above to perform continuous operation for a long period, resulting in a large amount of heat generation in the head. Therefore, it is not possible to perform satisfactory temperature control by the construction for head temperature control to be employed in the typical printer. Accordingly, when the elongated head is to be employed, it has been required to perform temperature control by circulating a fluid, such as water or so forth through a part of the head to restrict elevation of the head temperature.

SUMMARY OF THE INVENTION

It is an object of the present invention to provide a printing apparatus which can perform stable temperature control for a printing head generating a large amount of heat and being subjected to variation of environmental condition and thereby perform stable ejection.

In a first aspect of the present invention, there is provided a printing apparatus having a printing head performing printing by ejecting a liquid utilizing thermal energy, comprising:

a fluid passage provided in contact with the printing head;

fluid supply means for supplying a fluid into the fluid passage; and control means for controlling a temperature of the fluid to be supplied within a predetermined temperature range.

A printing apparatus may further comprise:

temperature detecting means for detecting a temperature of the printing head, and wherein the control means controls the temperature of the fluid within the predetermined temperature range on the basis of a detected temperature from the temperature detecting means.

The fluid supply means may continuously circulate the fluid within the fluid passage.

The fluid supply means may set flow velocity and a flow rate of the fluid in the fluid passage so that the temperature of the printing head is within the predetermined temperature range.

The predetermined temperature range of the fluid may be set in a range capable of controlling the temperature of the printing head within the predetermine temperature range.

The printing head may be an ink-jet printing head having an electrothermal transducer as a generating source of the thermal energy.

The fluid may be water.

In a second aspect of the present invention, there is provided a printing apparatus having a printing head performing printing by ejecting a liquid utilizing thermal energy, comprising:

thermal energy applying means for applying thermal energy to the printing head to make heat accumulation amount per unit period constant;

a fluid passage provided in contact with the printing head;

supply means for continuously supplying a predetermined amount of fluid into the fluid passage; and control means for controlling a temperature of the fluid to be supplied by the supply means to a predetermined temperature for making a heat value to be removed from the printing head within a unit period constant.

A printing apparatus may further comprise temperature detecting means for detecting a temperature of the printing head, and the control means controls the temperature of the fluid to the predetermined temperature on the basis of a detected temperature from the temperature detecting means.

The printing head may include an electrothermal transducer as a generating source of the thermal energy for ejecting the liquid, and the thermal energy applying means drives the electrothermal transducer.

In a third aspect of the present invention, there is provided a printing apparatus having a plurality of printing heads performing printing by ejecting liquid utilizing thermal energy, comprising:

thermal energy applying means for applying thermal energy to each of the printing heads so as to make respective heat accumulation amounts per unit period a predetermined amount;

fluid passages provided in contact with the printing heads, respectively;

supply means for continuously supplying a predetermined amount of fluid into each of the fluid passages; and control means for controlling a temperature of the respective fluids to be supplied by the supply means to a predetermined temperature so as to make a quantity of heat to be removed from the respective printing heads within a unit period a predetermined amount.

A printing apparatus may further comprise temperature detecting means for detecting a temperature of each of the printing heads, and the control means controls the temperature of each of the fluids to the predetermined temperature on the basis of detected temperatures from the temperature detecting means.

Each of the printing heads may include an electrothermal transducer as a generating source of thermal energy for ejecting the liquid, and the thermal energy applying means drives the electrothermal transducer.

A printing apparatus may further comprise a heater for auxiliarily heating respective of the printing heads, and the control means controls the temperature of a printing head whose temperature is lower than a given controlled temperature of the fluid to the predetermined temperature by driving the heating heater for the printing head on the basis of each of detected temperature from the temperature detecting means.

A printing apparatus may further comprise a heater for auxiliarily heating respective of the printing heads, and the control means controls the temperature of each of the fluids to a constant temperature and controls the temperature of a printing head whose temperature is lower than a given controlled temperature of the fluid to the predetermined temperature by driving the heating heater for the printing head on the basis of each of detected temperature from the temperature detecting means.

In a fourth aspect of the present invention, there is provided a printing apparatus for performing printing on a printing medium by employing a printing head, comprising:

a flow passage portion provided in the printing head for flowing a liquid in a direction to cause a distribution in temperature in the printing head; and means for generating a distribution of flow velocity of the liquid flowing in the flow passage portion depending upon the distribution in temperature.

The printing head may include a plurality of printing elements, and the direction causing the distribution in temperature is an aligning direction of the plurality of printing elements.

The means may cause the distribution of flow velocity by differentiating cross-sectional area with respect to the flow direction of the flow passage portion.

The cross-sectional area may be decreased at a constant ratio on the upstream side of the flow passage portion.

The cross-sectional area may be decreased and increased at constant ratio on upstream side and downstream side of the flow passage portion, respectively.

The printing head may generate a bubble in ink utilizing thermal energy and ejects the ink by generation of the bubble.

Ejection openings for ejecting ink of the printing head may form the printing elements.

In a fifth aspect of the present invention, there is provided an ink-jet head having a plurality of ink ejection openings, comprising:

a flow passage portion provided for flowing liquid along a direction of alignment of the plurality of ink ejection openings, and a cross-sectional area of the flow passage portion being differentiated in the flow direction.

According to the present invention, it is possible to effectively control temperature of a thermal printing head which is affected by temperature variation of external environment of the apparatus or generates a large amount of heat by supplying a fluid which is controlled within a predetermined temperature range by control means to a fluid passage provided in contact to the thermal printing head.

On the other hand, it becomes possible to simplify a control operation by continuously circulating the fluid through the fluid passage. It is also possible to appropriately perform temperature control, with a good responsiveness, without providing heating means for the printing head, by appropriately setting flow velocity (flow rate) of the fluid and continuously supplying or circulating the fluid through the fluid passage.

According to the present invention, in the case where non-uniformity of the head temperature in the aligning direction of the printing elements, such as ink ejection openings, for example, may be caused since a cooling fluid can flow in the aligning direction and the flow velocity of the fluid can be varied depending upon distribution of the head temperature to be caused, quantity of heat to be taken from the head per a unit period can be differentiated depending upon the head temperature distribution with taking self-temperature elevation of the fluid. By this, it becomes possible to unify the head temperature distribution.

BRIEF DESCRIPTION OF THE DRAWINGS

The present invention will be understood more fully from the detailed description given herebelow and from the accompanying drawings of the preferred embodiment of the invention, which, however, should not be taken to be limitative to the present invention, but are for explanation and understanding only.

In the drawings.

DESCRIPTION OF THE PREFERRED EMBODIMENT

The preferred embodiments of the present invention will be discussed hereinafter in detail with reference to the accompanying drawings. In the following description, numerous specific details are set forth in order to provide a thorough understanding of the present invention. It will be obvious, however, to those skilled in the art that the present invention may be practiced without these specific details. In other instance, well-known structures are not shown in detail in order not to unnecessarily obscure the present invention.

[Explanation of Overall Construction of Apparatus]

Figures 1A, 1B:
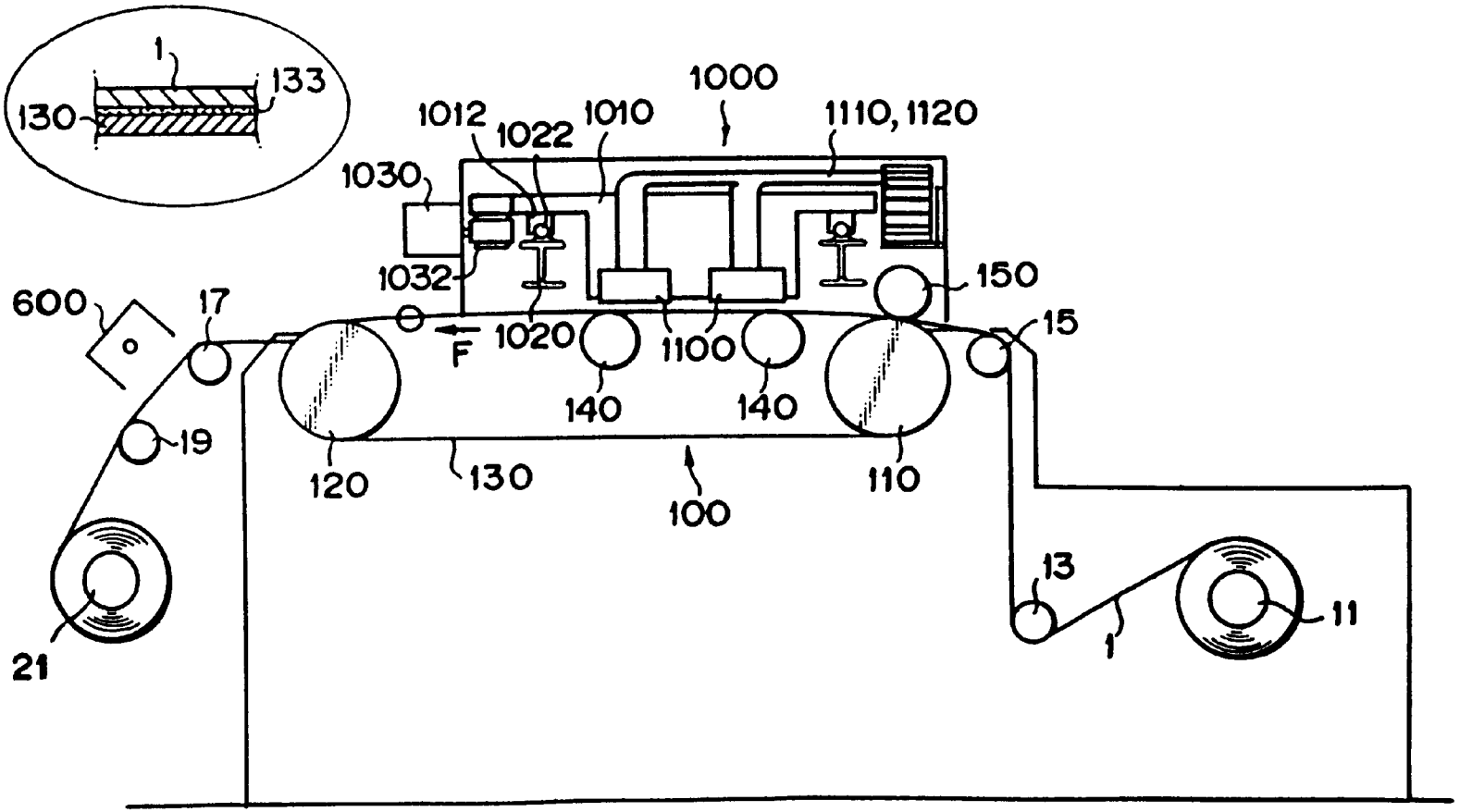
FIGS. 1A and 1B are a side elevation and an enlarged view showing a general construction of one embodiment of an ink-jet textile printing apparatus according to the invention.

General construction of an ink-jet textile printing apparatus as an example of a printing apparatus according to the present invention is illustrated in FIG. 1A. In FIG. 1A, reference numeral 1 denotes a cloth as a printing medium to be printed with an image, which is fed according to rotation of a feed roller 11, conveyed in a substantially horizontal direction by a conveying portion 100 provided at a position opposing to a printer portion 1000 via intermediate rollers 13 and 15, and subsequently taken up on a take-up roller 21 via a feed roller 17 and an intermediate roller 19.

The conveying portion 100 generally comprises feed rollers 110 and 120 provided upstream and downstream of the printing portion 1000 in a feeding direction of the cloth 1, a conveying belt 130 in the form of an endless belt wound between those rollers, and a pair of platen rollers 140 provided for stretching a predetermined range of the conveying belt 130 with an appropriate tension to restrict a printing surface of the cloth to be flat for improving flatness. Here, the conveying belt 130 is a metallic one as disclosed in Japanese Patent Application Laid-open No. 212851/1993. The disclosure of the above-identified publication is herein incorporated by reference. As shown in FIG. 1*b* in a partially enlarged form, an adhesive layer (sheet) 133 is provided on the surface of the metallic conveying belt 130. Then, the cloth 1 is firmly secured on the conveying belt 130 with the adhesive layer 133 by means of a pasting roller 150 to certainly provide flatness upon printing.

The cloth 1 conveyed in the condition certainly maintaining flatness is applied with a printing agent by the printer portion 1000 within a region between the platen rollers 140, and peeled off the conveying belt 130 or the adhesive layer 133 at the portion of the conveying roller 120 and taken-up on the take-up roller 21. During this process, drying process is performed by a drying heater 600. It should be noted that, as a drying heater 600, any appropriate form of heaters, such as that blowing heated air onto the cloth 1, irradiating infrared light and so forth may be employed.

[Explanation of Construction of Printer Portion]

Figure 2:
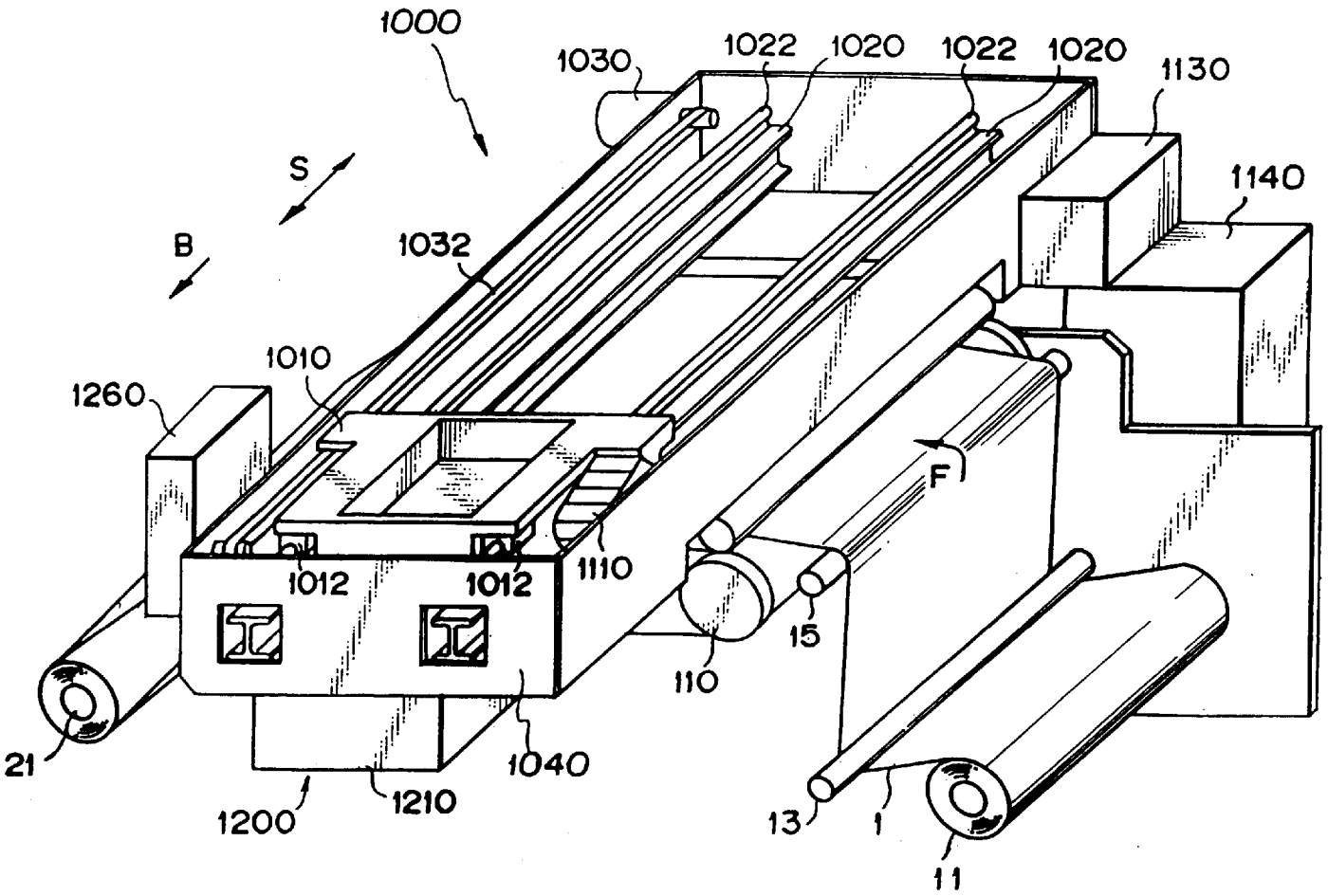
FIG. 2 is a perspective view showing a construction of a printing portion of the ink-jet textile printing apparatus of FIG. 1.

FIG. 2 is a perspective view diagrammatically showing the printer portion 1000 and a conveying system for the cloth 1.

In FIGS. 1A and 2, the printer portion 1000 includes a carriage 1010 which is scanned in a direction different from a conveying direction (auxiliary scanning direction) F of the cloth 1, for example in a width direction S of the cloth perpendicular to the conveying direction F. Reference numeral 1020 denotes support rails extending in the S direction (primary scanning direction), which support rails 1020 support a slide rail 1022, respectively. The glide rails 1022 support and guide sliders 1012 fixed to the carriage 1010. Reference numeral 1030 denotes a motor forming a driving power source for shifting the carriage 1010 in the primary scanning direction. A driving force of the motor 1030 is transmitted to the carriage 1010 via an appropriate transmission mechanism, such as a belt secured to the carriage 1010 or so forth.

The carriage 1010 holds a plurality of printing heads 1100, each having a plurality of ink ejection openings aligned in a predetermined direction (conveying direction F in the shown case), arranged in the direction perpendicular to the predetermined direction (the primary scanning direction S in the shown case). Furthermore, in this embodiment, the printing heads 1100 are arranged in two stages in the conveying direction. A plurality of printing heads 1100 are arranged in each stage corresponding to inks of different colors. Number of ink colors and number of printing heads may be appropriately selected depending upon the image or so forth to be formed on the cloth 1. For example, it is possible to employ the inks of three primary colors, i.e. yellow (Y), magenta (M) and cyan (C), or, in the alternative, black (Bk) may be added to the three primary colors. Also, it is possible to employ special colors (metallic colors, such as gold, silver, bright red, blue and so forth), in place of the colors set forth above. In the further alternative, it is also possible to employ inks of the same color but different densities.

In the shown embodiment, a plurality of the printing heads 1100 arranged in the primary scanning direction are provided in two stages in the conveying direction F as shown in FIG. 1. The ink colors, number of the printing heads to be arranged, order of arrangement of the printing heads and so forth may be the same in both stages or different between respective stages depending upon the image or so forth to be printed. Also, it is possible to perform redundant printing by the printing heads in the second stage for the region, in which printing is performed by primary scanning of the printing heads in the first stage (either in complimentary thinning printing or overlay printing by the printing heads in respective stages). It is further possible to assign different printing regions for respective printing heads in respective stages for performing high speed printing. Furthermore, the number of stages to arrange the printing heads is not limited to two stages but can be single stage, or three or more stages.

In the shown embodiment, as the printing head, an ink-jet head, such as a so-called bubble jet head which has heating elements for generating thermal energy to cause film boiling in ink as energy to be used for ejection of the ink, is employed. Then, for the cloth 1 conveyed in the substantially horizontal direction by the conveying portion 100, the printing head is used in the condition where the ink ejection openings are directed downwardly to avoid water head difference between respective ejection openings and thus to make ink ejecting condition uniform for enabling high quality image formation. In addition, the downward orientation of the ejection openings permits uniform recovery process for overall ejection openings. On the other hand, reference numeral 1040 denotes a support frame. A recovery mechanism 1200 for performing recovery operation by sucking ink from the ink ejection openings and a disposed ink tank 1210 for receiving discharged ink from the recovery mechanism 1200 are provided on the lower side of the support frame 1040 at a location out of the printing region for performing printing operation for the cloth 1.

For these printing heads 1100, a water tube for circulating cooling water discussed later are provided.

Figure 3:
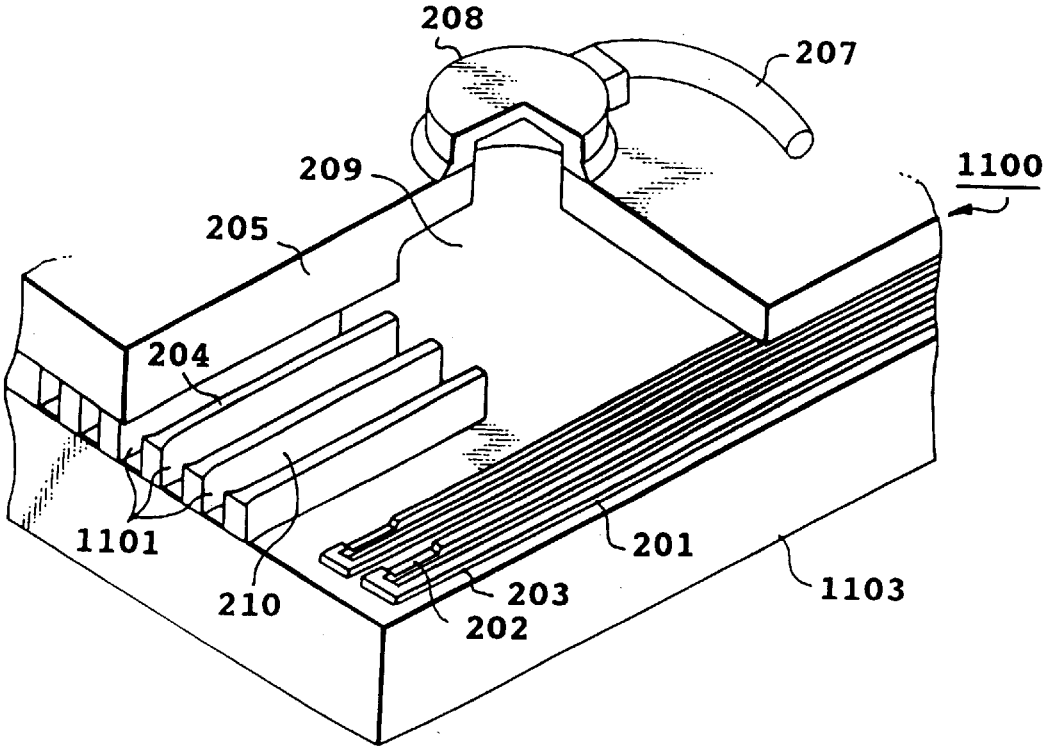
FIG. 3 is a perspective view showing a detailed construction of the ink-jet printing head to be employed in the ink-jet textile printing apparatus of FIG. 1.

FIG. 3 is a partially sectioned illustration of the printing head 1100 of the ink-jet system to be employed in the above-mentioned textile printing apparatus.

On a substrate 201, electrothermal transducers 202 and electrodes 203 for supplying electric power to the electrothermal transducer are formed by a semiconductor fabrication process, such as etching and so forth. Also, liquid passage walls 204 are formed on the substrate 201 at a location corresponding to the electrothermal transducers 202. An upper plate 205 is stacked on the substrate 201 on which the electrothermal transducers 202, the electrodes 203 and the liquid passage walls 204 are formed, to define ink passages 210 communicating with the ink ejection openings 1101 and a common liquid chamber 209. On the back side of the substrate 201, a base plate 1103 as a head structural component is connected. Ink is supplied to the common liquid chamber 209 in the printing head 1100 via a liquid supply tube 207 from an ink tank (not shown). It should be noted that reference numeral 208 denotes a connector for the liquid supply tube.

The ink supplied into the common liquid chamber 209 is supplied into the ink passages 210 by a capillary phenomenon to form a meniscus in the vicinity of the ejection openings 1101 at the tip end of the ink passages. By supplying power to the electrothermal transducers 202 under this condition, the ink on the electrothermal transducers 202 is heated to generate bubbles to eject an ink droplet through the ejection openings 211 by energy of bubbling.

Next, a mechanism associated with temperature control of the printing head 1100 according to the present invention will be discussed with reference to FIG. 4.

Here, reference numerals 1131 and 1132 are a head temperature detecting portion and a head heating portion provided on the back side of the base plate 1103 in the vicinity of the electrothermal transducer (heater) 202 of the printing head 1100. The head heating portion 1132 is located at an appropriate position for heating a region between the heater 202 and the common liquid chamber 209. A temperature detected by the head temperature detecting portion 1131 is fed to a control portion 1133 as an electric signal. Then, on the basis of the detected temperature, the head heating portion 1132 is driven to maintain the temperature of the printing head 1100 to be higher than or equal to a lower limit value of a predetermined allowable temperature range set for the printing head. On the other hand, reference numeral 1134 denotes a fluid passage provided on the back side of the base plate 1103. Through the fluid passage 1134, a fluid, such as water is circulated for maintaining the temperature of the printing head 1100 to be lower than or equal to an upper limit value of the predetermined temperature range.

Reference numeral 1135 denotes a circulation tube for supplying a fluid (water) to the fluid passage 1134; 1136, a main tank, 1137, a sub-tank, to which the water supplied to the fluid passage 1134 is returned. The shown water circulating circuit is designed to maintain a water head difference of H between the water stored in the main tank 1136 and the water collected in the sub-tank 1137. On the other hand, reference numeral 1138 denotes an electromagnetic valve interposed at the intermediate position of the circulation tube introducing the water into the fluid passage 1134 from the main tank 1136 and controlled for opening and closing by the control portion 1133. Reference-numeral 1139 denotes a circulation pump for automatically returning the water in the sub-tank 1137 to the main tank 1136 when the water level in the sub-tank 1137 reaches a predetermined level. The pump 1139 may be of the type serving to constantly return the water from the sub-tank 1137 to the main tank in the amount corresponding to the circulating amount of the water while water is circulated in the fluid passage 1134. Reference numerals 1140A and 1140B are water temperature sensors for detecting water temperature of the main tank 1136 and the sub-tank 1137, 1141A and 1141B are water temperature control systems which can control the temperature of the water on the basis of the detected water temperature from the water temperature sensors 1140A and 1140B.

In the temperature control mechanism of the shown embodiment of the printing head 1100, as set forth above, the temperature of the printing head 1100 is maintained within the predetermined temperature range by controlling the head heating portion 1132 and the electromagnetic valve 1138 on the basis of the temperature detection (electric) signal from the head temperature detecting portion 1131.

On the other hand, in the shown embodiment, the base plate 1103 of the printing head is made of aluminum and thus has much higher thermal conductivity coefficient than the upper plate 205 of glass. Therefore, it becomes possible to propagate thermal energy residing in the substrate 201 primarily to the base plate 1103 for external radiation during printing.

Namely, unless heat radiation from the base plate 1103 is performed with good response characteristics and high efficiency, elevating of temperature in the printing head 1100 becomes significant to make it impossible to stably perform printing. Therefore, it is necessary to efficiently and effectively remove the heat from the base plate 1103 during printing for maintaining the temperature of the printing head 1100 within the predetermined temperature range, and thus performing stable printing.

Figure 5A:
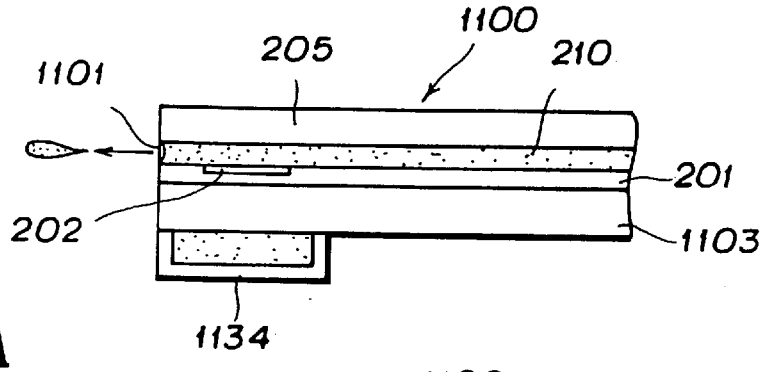
FIGS. 5A to 5D are sections respectively showing modification of the printing head.
Figure 5B:
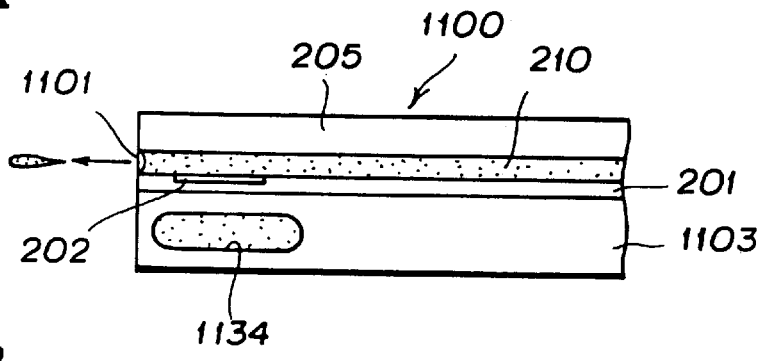
Figure 5C:
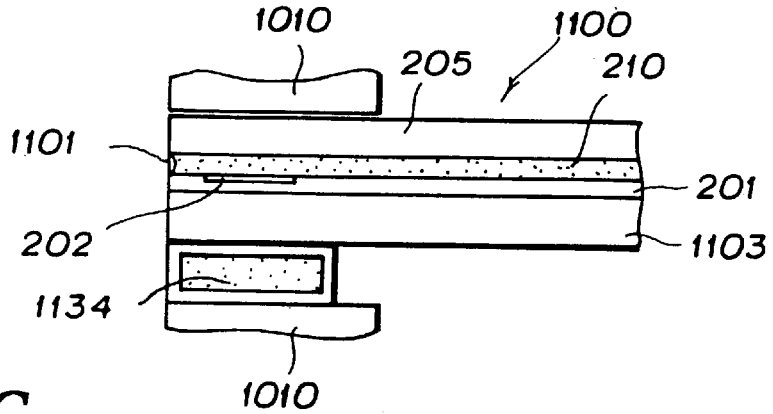

The foregoing is a reason why water having a relatively large thermal conductivity coefficient is employed as a fluid to perform temperature control of the printing head 1100. It should be noted that, in the shown embodiment, the fluid passage 1134 is located at the position as close as possible to the heater 202 and on the back side of the base plate 1103 of the printing head 1100 (see FIG. 5A). Here, the fluid passage 1134 is formed by fitting a grooved member defining a water passage with the back side of the base plate 1103. Thus, water flows directly flow on the base plate 1103 to make thermal conductivity as high as possible to effectively control the temperature of the base plate 1103 at desired temperature. On the other hand, the fluid passage 1134 is not limited to the foregoing construction. For example, as shown in FIG. 5B, the fluid passage 1134 may be formed in the base plate 1103 per se, which base plate 1103 is formed of aluminum having high thermal conductivity. In the alternative, as shown in FIG. 5C, it is possible to form the fluid passage 1134 on the side of the carriage 1010 of the printing apparatus and to bring the base plate 1103 of the printing head 1100 and the outer side of the fluid passage 1134 in contact upon loading of the printing head 1100.

Figure 4:
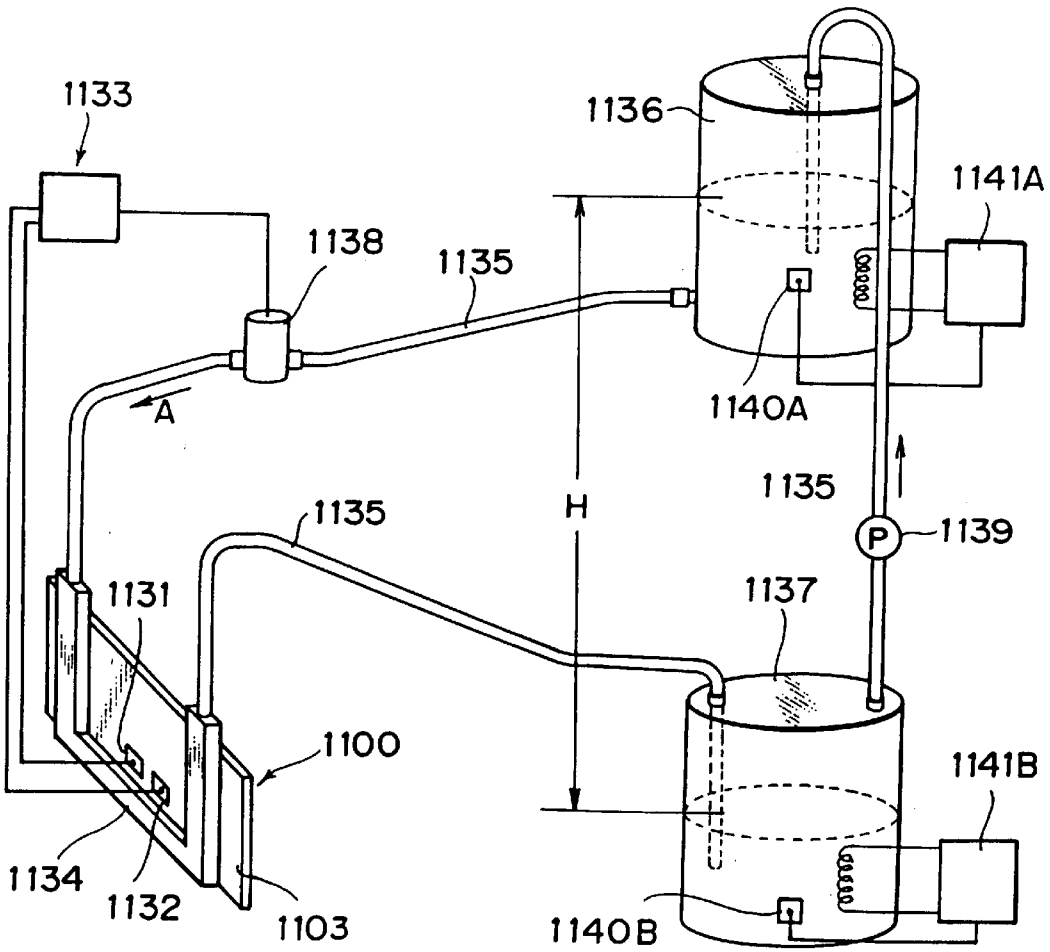
FIG. 4 is an illustration showing a general construction of a temperature controlling system for a printing head in the first embodiment of the ink-jet textile printing apparatus according to the invention.

It should be noted that, in FIG. 4, water accumulated in the main tank 1136 flows in the direction of arrow A due to the water head difference H and is returned to the sub-tank 1137 via the fluid passage 1134 by opening the electromagnetic valve 1138. In consideration of response characteristics of temperature control, it is preferable that a time difference between opening of the electromagnetic valve 1138 and resulting water flow in the fluid passage 1134 is as short as possible. Therefore, in the shown embodiment, an outlet of the circulation tube 1135 opening in the sub-tank 1137 is constantly positioned below the water level. Accordingly, in the circulation tube 1135 and the fluid passage 1134, water is filled constantly irrespective of opening and closing of the electromagnetic valve 1138.

One example of control operation of the heating portion 1132 and the electromagnetic valve 1138 will be discussed with reference to FIGS. 6A and 6B.

Figure 6A:
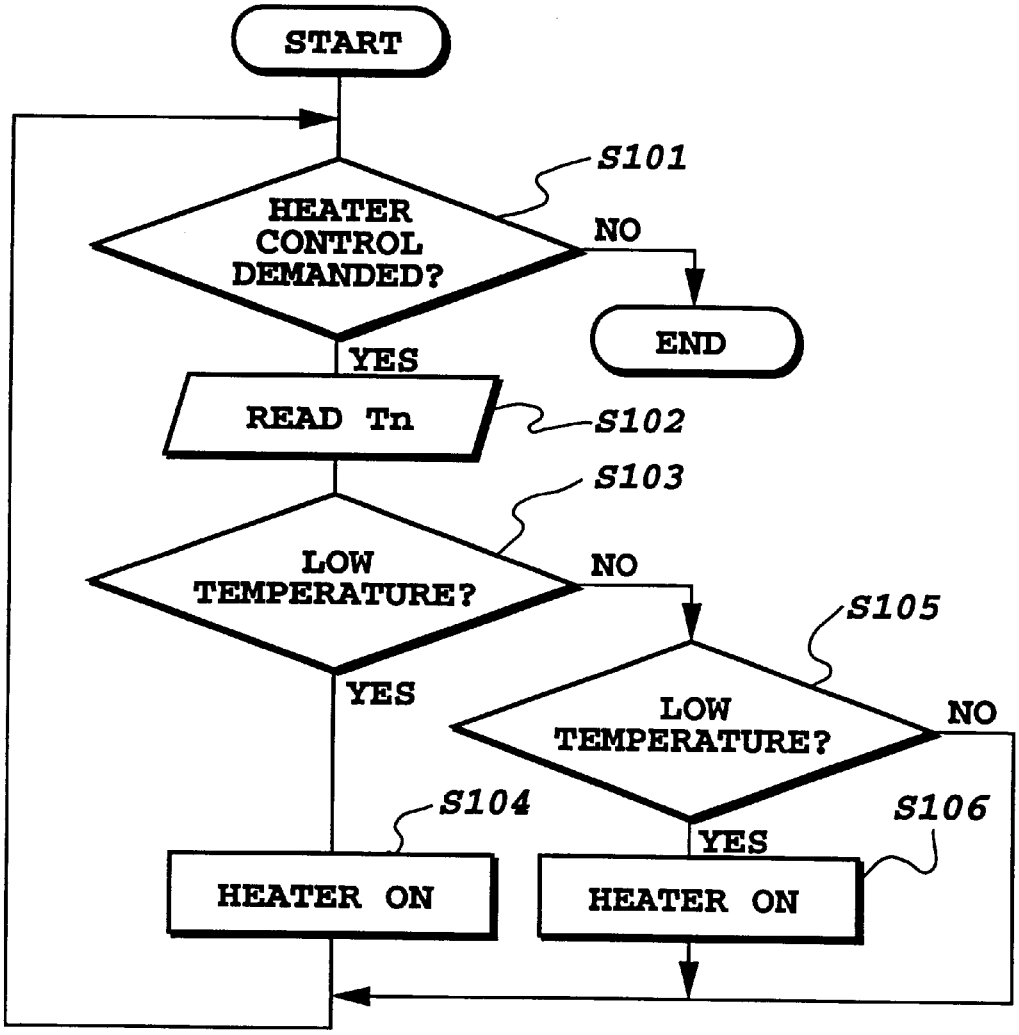
FIGS. 6A and 6B are flowcharts respectively showing examples of operation sequence of a heating means and an electromagnetic valve according to the invention.

FIG. 6A shows a procedure of control operation of the heating portion 1132. When the power source of the apparatus is turned "ON", at first, judgement is made whether a heating control demand is present or not, at step S101. If the answer at step S101 is YES, a temperature data Tn (n=0 to 3) from the temperature detecting portion 1131 is read out at step S102. At step S103, judgement is made whether the temperature of the printing head 1100 is lower than a set temperature range on the basis of the temperature data Tn or not. If the temperature of the printing head 1100 is lower than the set temperature range, the process is advanced to step S104 to drive the heating portion 1132 for heating. On the other hand, when the temperature of the printing head 1100 is not lower than the set temperature range as checked at step 103, the process is advanced to step S105 to make judgement whether the temperature of the printing head is higher than the set temperature range or not. If the temperature of the printing head 1100 is higher, power supply for the heating means 1132 is turned "OFF" at step S106. If the temperature of the printing head 1100 is not higher, the printing head 1100 is left as is. By repeating the foregoing operation, control of the heating portion 1132 is performed. On the other hand, if judgement is made that when the heating control demand is not present, control operation is terminated.

Figure 6B:
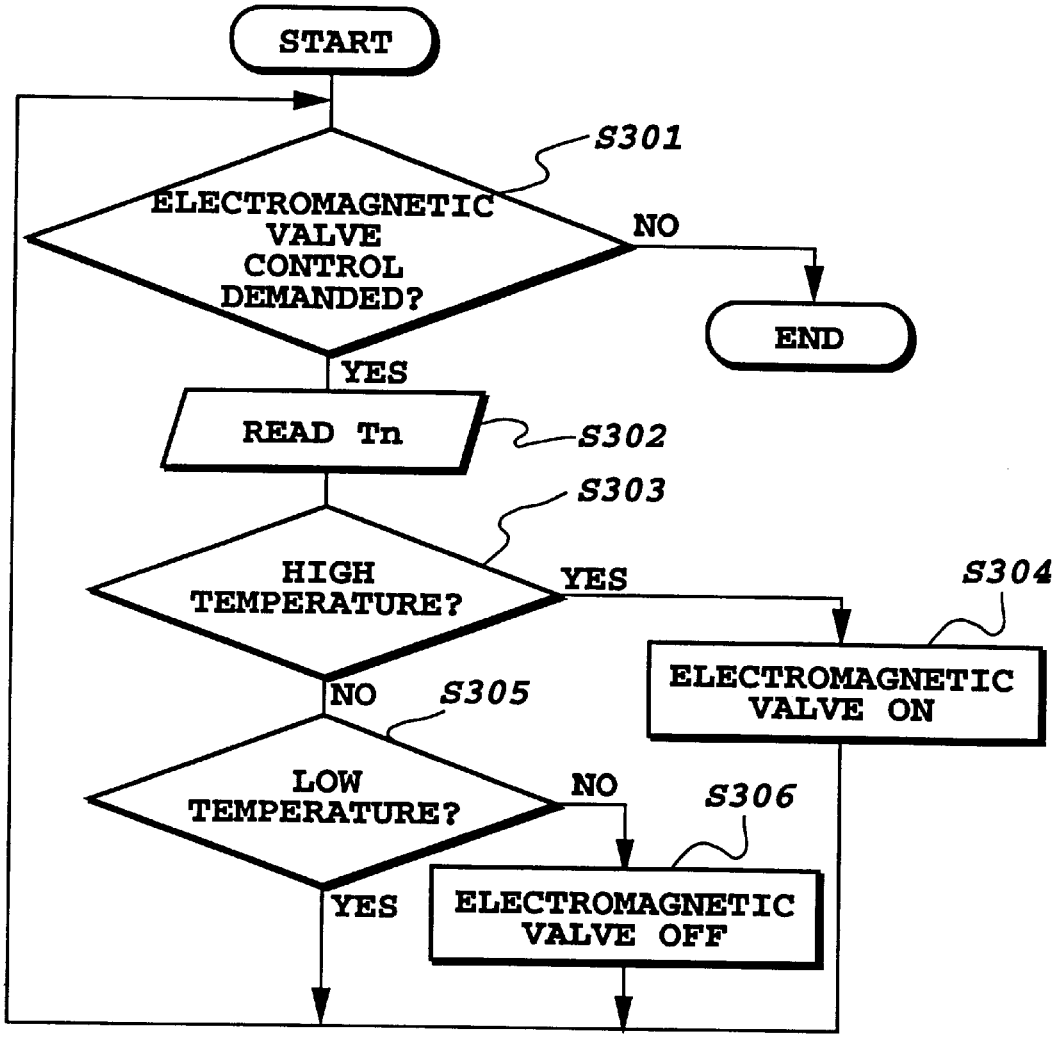

FIG. 6B shows a procedure of control operation of the electromagnetic valve 1138. When the power source of the apparatus is turned ON, judgement is made whether a demand for the electromagnetic valve control is present or not at step S301. If the demand is present (YES), the process is advanced to step S302 to read out the temperature data Tn from the temperature detecting portion 1131. At step S303, judgement is made whether the temperature data Tn is higher than the set temperature range or not. If the temperature data Tn is higher than the set temperature range, the electromagnetic valve 1138 is turned ON at step S304. Here, if the temperature data Tn is not higher than the set temperature range, the process is advanced to step S305 to make judgement whether the temperature data is lower than the set temperature range or not. If the temperature data is lower than the set temperature range, the electromagnetic valve 113 is turned OFF at step S306, and otherwise, the electromagnetic valve 1138 is held as is. By repeating the foregoing operating procedure, the electromagnetic valve 1138 is controlled. If the demand for control is not present as checked at step S301, control operation is terminated.

It should be noted that, as set forth above, a flow rate of water, namely flow velocity in the fluid passage 1134 is determined by the water head difference H between the water level in the main tank 1136 and the water level in the sub-tank 1137. Therefore, the water head difference is set so that sufficiently high flow velocity for temperature control of the printing head 1100 is obtained.

On the other hand, timing control for driving the pump 1139 may be performed by a signal with mounting a remaining amount detecting sensor in the main tank 1136 or the sub-tank 1137. Also, the driving timing of the pump may be determined depending upon the number of times of opening and closing of the electromagnetic valve 1138 or a period of time thereof. Furthermore, the water temperature sensors 1140A and 1140B are provided in the main tank 1136 and the sub-tank 1137 to control respective water temperatures by the water temperature control systems 1141A and 1141B on the basis of the detection signals thereof for maintaining the water temperature within a given temperature range. It should be noted that the set temperature range to maintain the water temperature may be set permanently at constant range irrespective of external and internal environmental conditions. In the alternative, it is also possible to control the water temperature by establishing a temperature control table defining the water temperature range relative to the environmental temperature, such that when the environmental temperature is a° C. to b° C., the water temperature range is between c° C. to d° C.

By controlling the temperature of the water to be circulated within the given water temperature range, the desired cooling effect can be obtained constantly. Therefore, in combination with heating by the heating portion 1132, the temperature of the printing head 1100 can be easily controlled.

Also, by the water temperature control systems 1141A and 1141B, the temperature of the printing head 1100 is held constant relative to variation of the environmental temperature surrounding the printing portion 1000, printing operation can be stably performed within the predetermined temperature variation range. As a result, desired printing quality can be maintained. Particularly, in the shown embodiment, since the fluid having a high thermal conductivity coefficient, such as water, is employed as a fluid for temperature adjustment of the printing head 1100, the fluid temperature significantly influences for the calorific value to be transmitted. Therefore, it becomes important to suppress variation of the water temperature depending upon the environmental temperature in order to maintain the temperature of the printing head 1100 within the predetermined temperature range.

Particularly, in the case of the printing head which generates a large amount of heat and causes substantial temperature elevation during printing operation, a cooling effect can be obtained which stably maintains the printing head temperature within the predetermined range by setting the temperature range of the water at lower values.

It should be noted that while the water temperature sensors 1140A and 1140B and the water temperature control systems 1141A and 1141B are provided in both of the main tank 1136 and the sub-tank 1137 in the shown embodiment, it is possible to perform the water temperature control by providing the water temperature sensor and the water temperature control system only in the main tank.

On the other hand, in the embodiment shown in FIG. 4, since the water flow passage system is a recirculating system, it is preferred to employ pure water so as not to vary the flow rate and flow velocity flowing through the printing head 1100 due to deposition of impurity in the circulation tube 1135 or the fluid passage 1134. Furthermore, it is also preferred to use materials having high heat insulative effect for the main tank 1136, the sub-tank 1137 and the circulation tube 1135 forming the water flow passage system so as to minimize heat transmission of the external temperature variation to the water.

[Second Embodiment]

Figure 7:
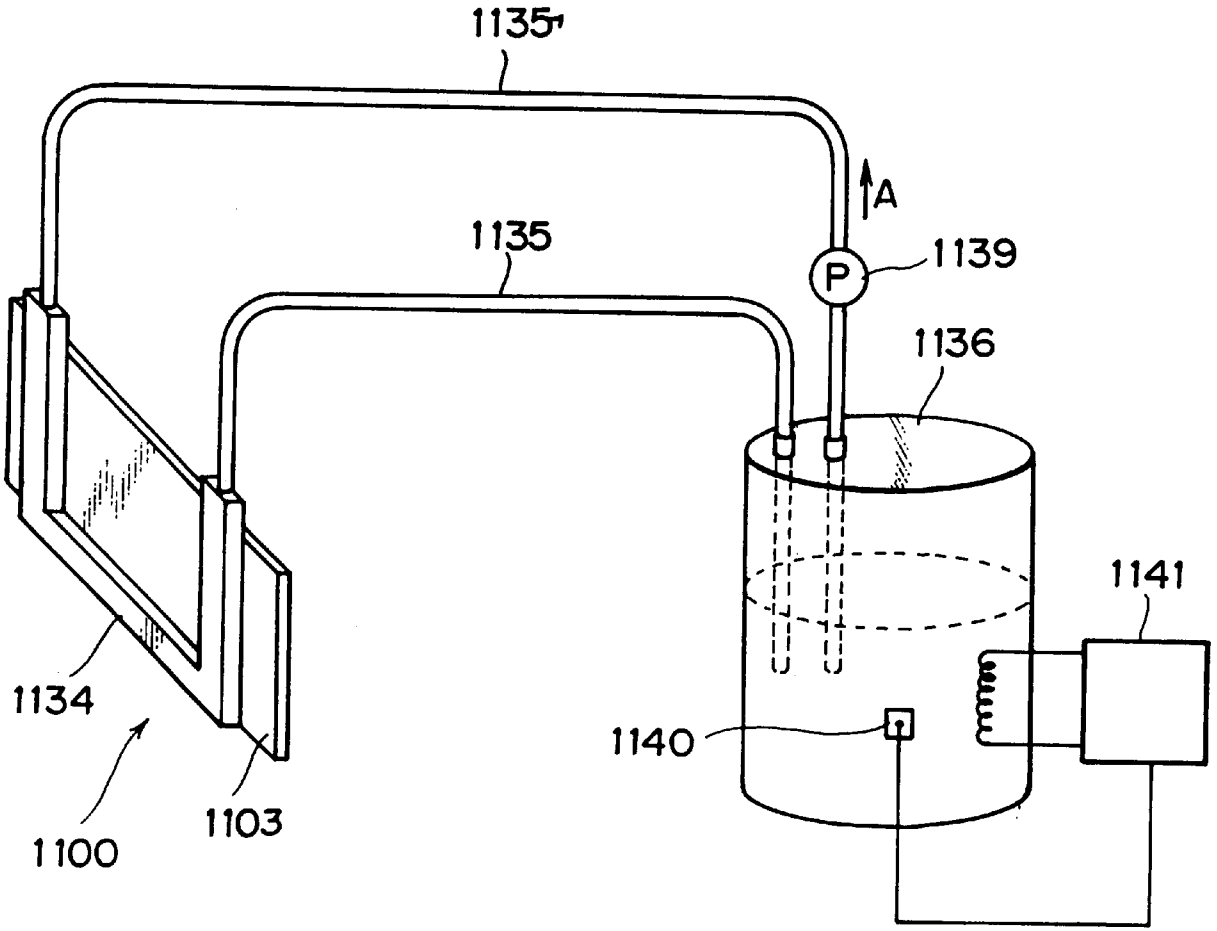
FIG. 7 is an illustration showing a general construction of a temperature control system of the printing head in the second embodiment of the ink-jet textile printing apparatus according to the invention.

FIG. 7 shows the second embodiment applied for a serial type ink-jet printing apparatus. In the shown embodiment, temperature of water temporarily accumulated in the main tank 1136 is maintained at a predetermined temperature with a water temperature sensor 1140 and a water temperature control system 1141 controlled depending upon a detection signal of the water temperature sensor.

In this embodiment, the water maintained at a substantially constant temperature within the main tank 1136, is supplied in the direction of arrow A by the pump 1139 and recirculated into the main tank 1136 again via the circulation tube 1135 and the fluid passage 1134. Here, the pump 1139 is continuously driven during printing operation of the ink-jet printing apparatus (printer portion) 1000 and waiting period for printing operation before and after the printing operation. As a result, a water flow flowing through the circulating tube 1135 and the fluid passage 1134 is circulated at constant flow velocity. The set temperature and conditions of flow velocity (flow rate) will be discussed later.

Figure 5D:
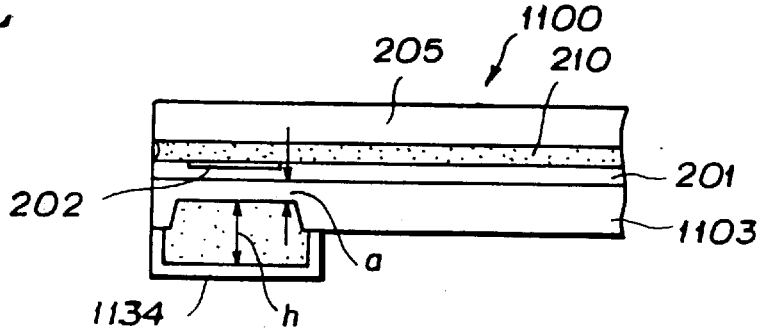

It should be noted that, in the shown embodiment, the fluid passage 1134 is constructed such that the water directly contacts the base plate 1103 similarly to the first embodiment. An example of construction of the fluid passage 1134 adapted to the shown embodiment is illustrated in FIG. 5D. As shown in FIG. 5D, in the base plate 1103, a groove recessed toward the heater 202 is formed in the vicinity of the heater 202. This is for transmitting quantity of heat of the water to the ink in the liquid passage 210 on the substrate 201 in the vicinity of the heater 202 with high response characteristics and with high efficiency by reducing a heat transmission distance of the base plate 1103. Therefore, the thickness a in the groove of the base plate 1103 is preferred to be as thin as possible in a range not affecting electrothermal transducing efficiency of the heater 202.

According to this embodiment, since this has the fluid passage 1134 disposed on the printing head 1100, the pump 1139 continuously circulating water in the fluid passage 1134 and the water temperature control system 1141 which always maintains the water at the predetermined constant temperature, it is possible to maintain the temperature of the printing head 1100 within a temperature range performing stable printing without providing any heating portion or temperature detecting portion in the printing head 1100.

Hereinafter, a temperature control operation will be exemplarily discussed together with setting of the water temperature and setting conditions of flow velocity (flow rate) of the water circulating within the fluid passage 1134.

Now, it is assumed that stable ejection and desired printing quality can be obtained when the temperature of the substrate 201 in the vicinity of the heater 202 of the printing head 1100 can be maintained between d° C. (upon low temperature) to e° C. (upon high temperature). While the printing head 1100 is placed in waiting state for printing operation, power is not supplied to the heater 202. Therefore, no heat is generated from the heater 202. However, when water maintained at the temperature of (d+f)° C. (f is a temperature to be lost by heat transmission) is circulated at the flow velocity higher than or equal to certain flow velocity g (m/s) and at the flow rate greater than or equal to a certain flow rate h (1/min), the temperature in the vicinity of the heater 202 is maintained at lower criterion temperature d° C. even if the heating portion is not provided in the printing head 1100. At this time, higher heat transmission efficiency between the water and the base plate 1103, higher thermal conductivity of the base plate 1103 and the substrate 201, and thinner thickness result in a smaller value of f.

On the other hand, while the printing head 1100 is in printing operation, power is supplied to the heater 202 at a given timing, and thus heat is generated from the heater 202.

In such a printing condition, it is desired by circulating the water at the set temperature of (d+f)° C. determined upon waiting state for printing, to maintain the temperature in the vicinity of the heater 202 to be lower than or equal to e° C. as the high temperature criterion with suppressing heat accumulation caused by possible maximum heat generation quantity i (W) from the heater 202 during printing operation. The flow velocity j (>g) (flow rate k (>h)) of the water for accomplishing this will be set in the following manner.

Figure 8:
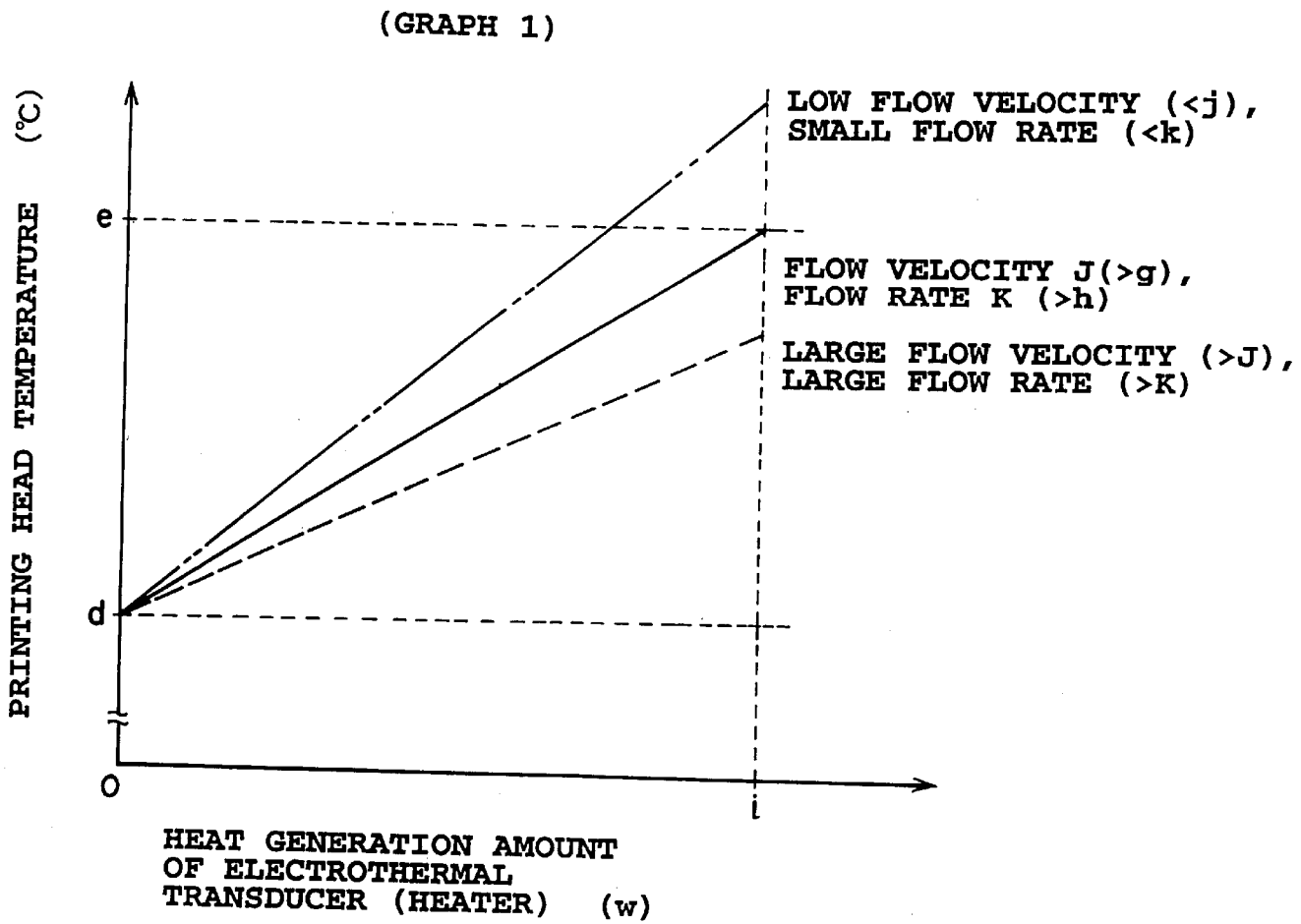
FIG. 8 is a graph 1 showing temperature variation characteristics of the printing head when a flow velocity and flow rate are varied with respect to variation of a heat generation amount of a electrothermal transducer in the second embodiment.

A graph 1 shown in FIG. 8 shows variation of the temperature in the vicinity of the heater 202 of the printing head when the water at the temperature of (d+f)° C. is circulated with varying the flow velocity j (flow rate k), with respect to variation of the heat generation amount of the heater 202.

In the graph 1, when the heat generation amount of the heater of the electrothermal transducer is 0 (W), namely in the waiting state for printing, the set temperature of the water for maintaining the temperature of the printing head at d (° C.) is (d+f) (° C.). At this set temperature, if the flow velocity j (flow rate k) is too low and the heat generation amount from the heater 202 is the maximum i (W), it becomes impossible to restrict the temperature of the printing head 1100 to be lower than or equal to e° C. as shown by two-dotted line. Therefore, by gradually increasing the flow velocity j (flow rate k) and setting to be higher than or equal to flow velocity J (flow rate K (>h)), the temperature in the vicinity of the heater 202 can be restricted at e° C. even when the heat generation amount from the heater 202 is the maximum i, as shown by solid line.

It should be noted that, at this criterion flow velocity J (>g) (flow rate K (>h)), the water at the flow velocity higher than the flow velocity g (flow rate h) is circulated even when the heat generation amount from the heater 202 is 0. Therefore, the temperature in the vicinity of the heater 202 can be naturally maintained at d° C. Also, as shown by broken line, by further increasing the flow velocity j (flow rate k), the temperature of the printing head can be maintained within a more stable temperature range.

As set forth above, by setting the water temperature and the flow velocity (flow rate), the temperature in the vicinity of the electrothermal transducer 202 can be maintained within the range of d° C. to e° C. with respect to the entire variation of the heat generation amounts from 0 to the maximum i (W).

It should be appreciated that the foregoing discussion has been given on the premise that the water temperature can be maintained at (d+f)° C. without causing temperature variation. However, in practice, it is not easy to constantly maintain the water temperature at (d+f)° C. without causing any temperature variation.

Figure 9:
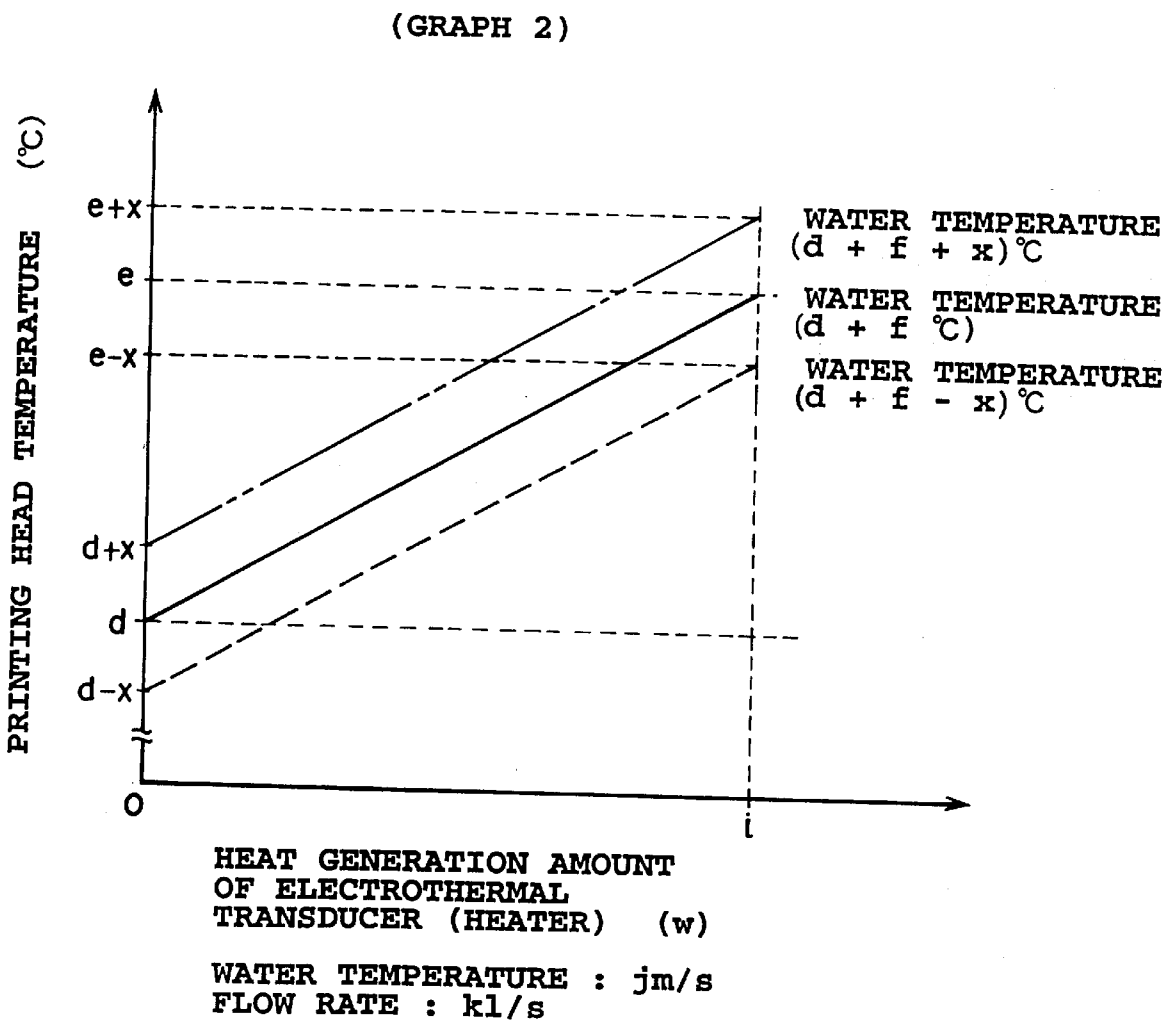
FIG. 9 is a graph 2 showing temperature variation characteristics of the printing head when a water temperature is varied relative to variation of the heat generation amount of the electrothermal transducer in the second embodiment.

Here, it is assumed that the water temperature cannot be maintained at (d+f)° C. to cause variation within a range of ±X° C. In this case, if the water temperature and the flow velocity (flow rate) are set as set forth above, as shown in graph 2 of FIG. 9, when the heat generation amount is 0 (W) and the water temperature is (d+f−X)° C., the temperature of the printing head becomes (d−x)° C. to be lower than d° C. to cause overcooling. On the other hand, at the heat generation amount being i (W), as shown by two-dotted line, when the water temperature is (d+f+X)° C., the temperature of the printing head becomes (e+x)° C. to cause lack of cooling performance.

Figure 10:
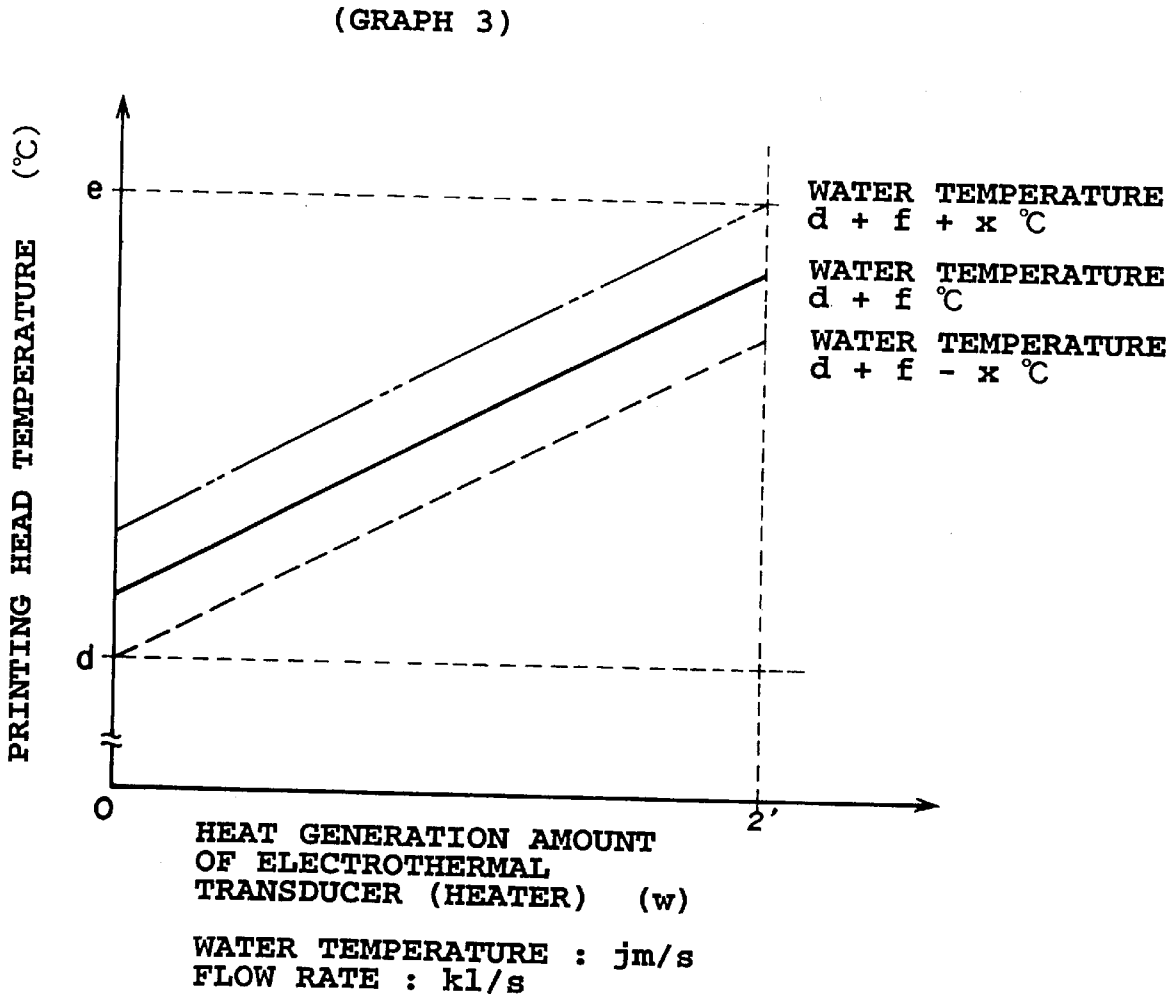
FIG. 10 is a graph 3 showing temperature variation characteristics of the printing head, different from that of FIG. 9, relative to variation of heat generation amount of the electrothermal transducer.

Therefore, in order to constantly maintain the temperature of the printing head within the range of d° C. to e° C., as shown in graph 3 of FIG. 10, it becomes necessary to determine the set temperature value and the flow velocity (flow rate) with considering the water temperature variation (±X° C.). Namely, when the water temperature to maintain the temperature in the vicinity of the heater 202 of the printing head 1100 at d° C. at the heat generation amount being 0 is set at (d+f−X)° C., the flow velocity (flow rate) is set to be sufficient for maintaining the temperature in the vicinity of the heater 202 of the printing head 1100 to be lower than or equal to e° C. at the heat generation amount being the maximum i (W) with the water temperature at (d+f+X)° C. which is higher than the above mentioned water temperature by 2X° C., as shown by two-dotted line in graph 3.

By determining the water temperature and the flow velocity (flow rate) as set forth above, even when the water temperature is varied within the range of ±X° C. with respect to the water temperature set value (d+f)° C., the temperature in the vicinity of the heater 202 in the printing head 1100 can be maintained within the range of d° C. to e° C. with respect to overall variation in the heat generation amount from 0 to i (W).

It should be noted that the flow velocity and the flow rate are dealt similarly in the foregoing discussion. This is because that the flow velocity and the flow rate are mutually proportional to each other as long as the sectional area of the fluid passage 1134 and the overall flow passages are fixed.

However, in the practical heat transmission, the flow velocity is more influential when the area for cooling is the same, it becomes necessary to determine the configuration of the fluid passage 1134 to obtain large flow velocity even at small flow rate (for obtaining a large heat transmission effect even by flowing a small amount of water).

For example, in FIG. 5D set forth above, assuming that the fluid passage 1134 is formed of a material having quite small thermal conductivity coefficient, heat in the base plate 1103 is transferred to the water only at the contacting surface between the water and the base plate 1103, and other contacting area between the water and the fluid passage 1134 may not directly contribute for heat transmission. Therefore, by lowering the height (h) of the fluid passage 1134 to make the cross sectional area of the water passage smaller with maintaining the desired flow velocity, the amount of water to be used for temperature control can be reduced.

As set forth above, in the shown embodiment, without providing the heating portion and the temperature detecting portion within the printing head, the temperature in the vicinity of the heater 202 of the printing head can be maintained within the temperature range, in which printing can be performed stably.

[Third Embodiment]

Figure 11:
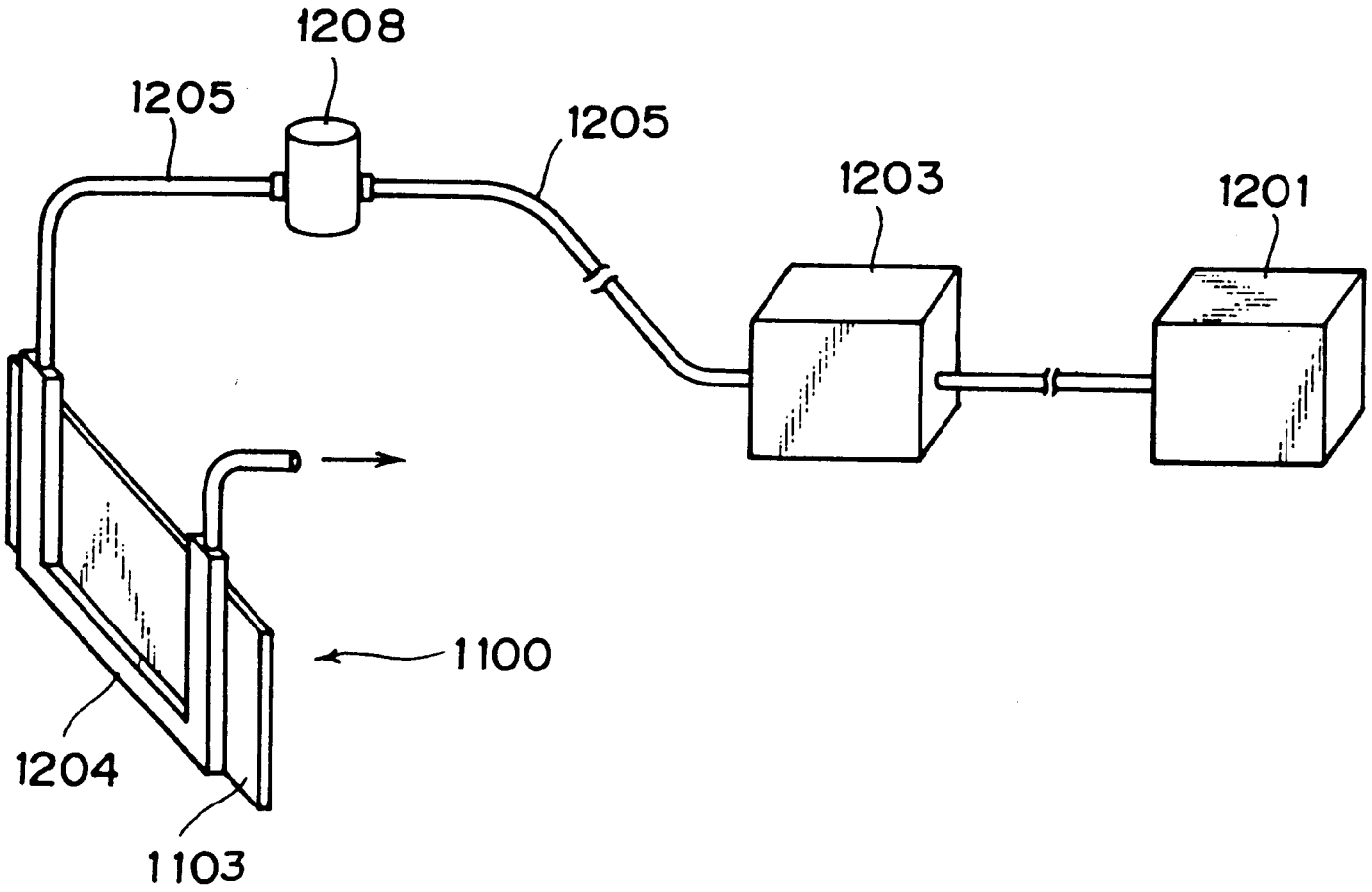
FIG. 11 is an illustration showing a general construction of the third embodiment of the temperature control system for the printing head according to the invention.

FIG. 11 shows the third embodiment similarly applying a serial type ink-jet printing apparatus (printer portion) 1000.

The shown embodiment is designed for maintaining the temperature in the vicinity of the heater 202 of the printing head 1100 at a temperature range, in which stable printing can be performed, by ON/OFF controlling the heating portion (not shown) and an electromagnetic valve 1208 controlling blowing of gas compressed to be higher than or equal to at least 1 atom on the basis of the detection signal of a temperature detecting sensor (not shown) mounted on the printing head 1100.

Here, gas (for example, air) is compressed by means of an air compressor 1201. The gas is controlled at a desired temperature by means of an air temperature control system 1203, and then injected into the fluid passage 1204 provided on the base plate 1103 from an air nozzle (not shown). Reference number 1205 denotes a compressed air supply tube. It should be noted that as the air temperature control system 1203, a known air cooling device may be utilized. Also, it is possible to provide a not shown metallic spiral pipe having high thermal conductivity around the supply tube and to cool the compressed air to be a temperature lower than or equal to the desired temperature via the water in the pipe. It should be noted that the compressed air may be ejected toward the base plate 1103 of the printing head 1100 and then opened to the atmosphere. By the effect of adiabatic expansion to be caused at this time, the temperature of the ejected air becomes lower than the temperature of the air compressed by the air compressor 1201.

In the shown embodiment, by providing the temperature control portion of the air together with the effect of adiabatic expansion, higher temperature control performance for the printing head which generates a larger amount of heat than the conventional air control system employing a blower or so forth can be achieved to make influence of the environmental temperature outside of the apparatus smaller.

[Fourth Embodiment]

The temperature control of the printing head by the shown embodiment is performed by providing the fluid passage in contact with the printing head, means for continuously supplying fluid to the fluid passage, control means for controlling the fluid to be supplied at a predetermined temperature and a driving mechanism of the printing head for applying power to the extent not to cause ink bubbling even while a printing signal is OFF.

Namely, as disclosed in Japanese Patent Application Laid-open No. 47948/1992 (the disclosure of this publication is herein incorporated by reference), a heat accumulation amount of a printing head per unit period is to be constant irrespective of a printing stand-by state or printing state by applying the electric (heat) energy to the extent not causing ink bubbling to the heater, on which the printing signal is OFF. The temperature of such printing head can be maintained at a desired temperature, at which stable ejection can be performed, by continuously flowing fluid controlled at constant flow velocity and a constant temperature to a fluid passage disposed in contact with the printing head with removing a constant amount of heat from the head per unit period.

Figure 12A:
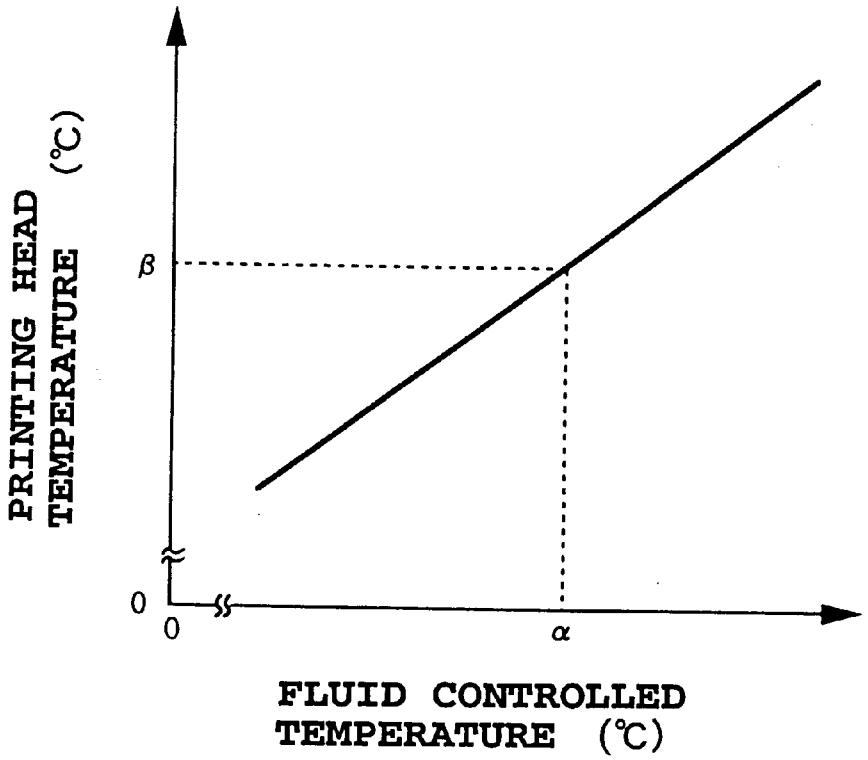
FIGS. 12A and 12B are graphs respectively showing characteristic curves of the fourth embodiment of temperature control for the printing head according to the invention.

For example, assuming that the heat accumulation amount of the printing head per unit period is constant and that the flow velocity of the fluid continuously flowing through the fluid passage provided in contact with the printing head is constant, the temperature of the printing head can be maintained at a specific temperature β° C. corresponding to the controlled temperature α° C. of the fluid as shown in FIG. 12A.

However, in practice, due to influence of the environmental temperature surrounding the apparatus, or due to difference of heat transmission performance and heat radiation performance, such as tolerance between individual components (including tolerance between the fluid passages) in the heat transmission structure and heat radiation structure of each individual printing head upon exchanging of the printing head or in the case of printing apparatus performing color printing with employing a plurality of printing heads, the temperature of the printing heads cannot be always β° C. relative to the control temperature α° C., a problem of fluctuation of the printing density or color balance can be caused by the environmental temperature around the apparatus or at every occurrence of exchanging of the printing head.

Figure 12B:
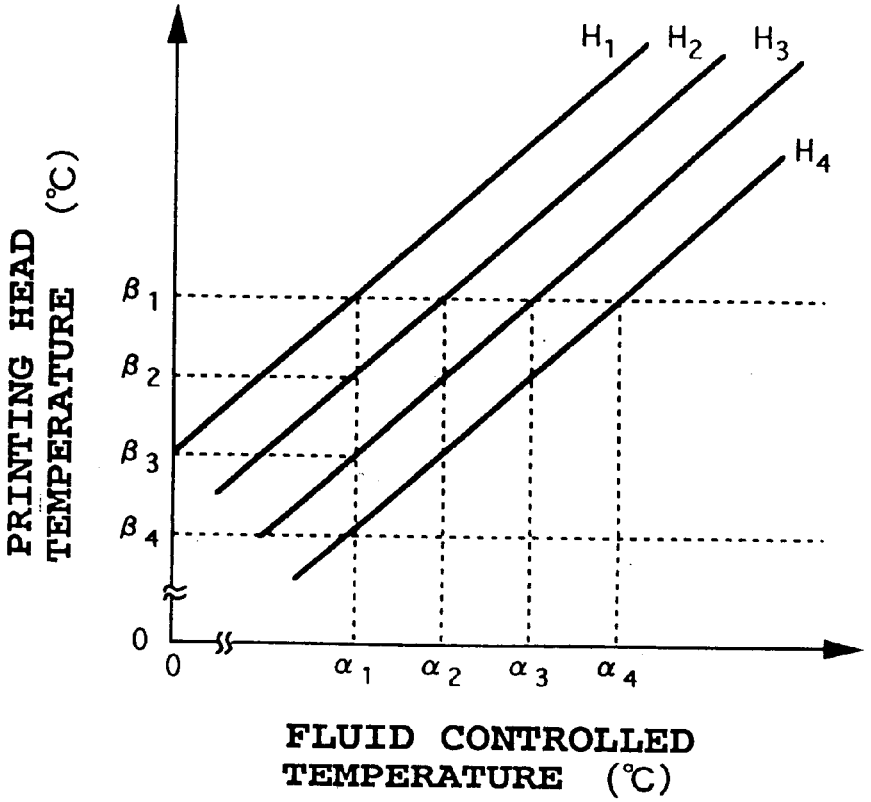

For example, as apparent from a graph of FIG. 12B showing a relation between controlled temperatures of the fluid flowing through the fluid passage provided in contact with the printing head and temperatures of the printing head maintained in correspondence to each of the controlled temperatures of the fluid, the printing head is maintained at the constant temperature β1° C. with respect to the constant controlled temperature α1° C. of the fluid only in the specific printing head (H1) and under specific environmental temperature condition. When the environmental temperature is varied, the temperatures of a plurality of the printing heads are not always maintained at the constant temperature. This is because in addition to heat transmission performance of the fluid continuously flowing through the fluid passage, the natural heat radiation from other part, on which the fluid does not flow, slightly influences the printing head temperature.

On the other hand, in the graph of FIG. 12B, as shown by H1, H2, H3, H4, when tolerances in each individual printing head are present to differentiate heat transmission performance and heat radiation performance, even if the controlled temperature of the fluid is set to α1° C., the temperature to be maintained in the printing heads may vary depending upon individual difference as β1° C. to β4° C.

In order to maintain the temperature of a plurality of the printing heads at the desired temperature despite the problem set forth above, the printing apparatus according to the present invention has temperature detecting portions for detecting temperature of respective printing heads and means for controlling the temperature of the fluid flowing through the respective printing heads on the basis of the detection signals of the temperature detecting portions.

For example, when the temperature of the printing heads is desired to be constantly maintained at β1° C., in the graph of FIG. 12B, for the printing heads H1, H2, H3 and H4 having mutually different heat transmission and heat radiation performances, the temperatures of the printing heads can be maintained at the desired temperature β1° C. in all of the heads (H1 to H4) by setting and controlling the temperatures of the fluid at α1° C., α2° C., α3° C. and α4° C., respectively.

Namely, when the head temperature detected by the temperature detecting means is lower than the desired temperature, the controlled temperature of the fluid is set at higher temperature, and when the head temperature detected by the temperature detecting means is higher than the desired temperature, the controlled temperature of the fluid is set at lower temperature, and thus the foregoing problem may be solved to maintain the stable operating temperature (in the shown embodiment of the temperature controlling system for the printing head, in which temperature control is performed by continuously supplying fluid for the printing heads).

At this time, by employing a heating heater different from the heater for ink ejection in the printing head for auxiliarily performing heating, highly stable temperature control can be more easily performed.

Figure 13A:
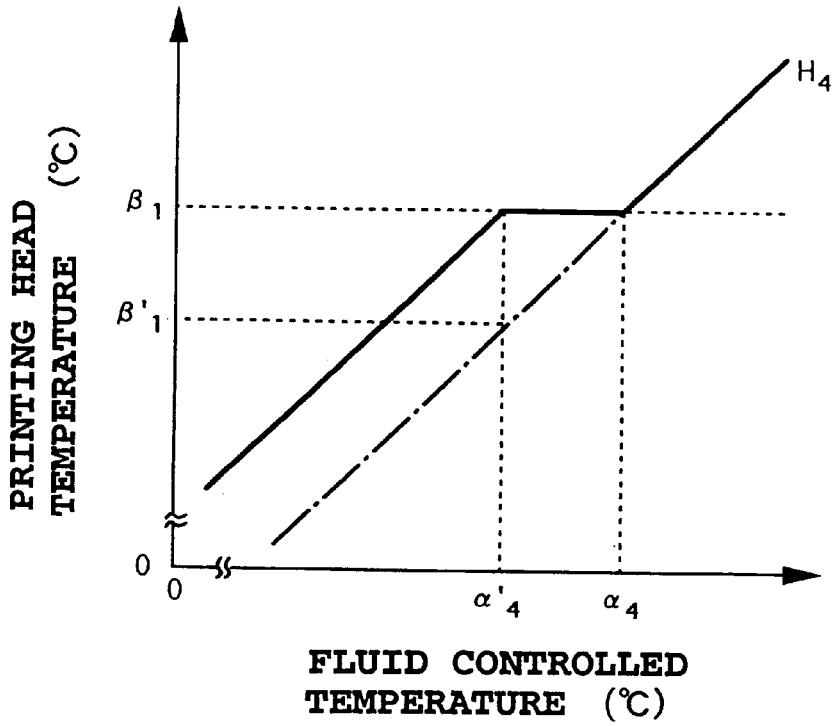
FIGS. 13A and 13B are graphs respectively showing characteristic curves of the fourth embodiment of temperature control for the thermal printing head according to the invention.

Graph in FIG. 13A shows a relationship between the controlled temperature of the fluid and the temperature, at which the printing head is maintained with respect to the fluid temperatures in the case where the heating heater is provided with the printing head H4 in the graph of FIG. 12B to perform control by turning ON the heating heater when the temperature of the printing head is lower than or equal to β1° C. and turning OFF the heating heater when the temperature of the printing head is higher than or equal to β1° C.

If the heating heater is not driven, when the fluid is controlled at the temperature lower than α4° C., overcooling is caused to make it impossible to maintain the temperature of the printing head at the desired temperature β1° C. (dotted line in the graph). In contrast to this, when the heating heater is driven, the characteristics become as shown by solid line.

In the characteristics shown by solid line in the graph of FIG. 13A, in the range of the controlled temperature of the fluid higher than α4° C., the temperature of the printing head becomes higher than β1° C. to make it impossible to maintain the desired printing head temperature β1° C.

On the other hand, in the characteristics shown by solid line in the graph of FIG. 13A, in the range of the controlled temperature of the fluid lower than α4° C. and higher than α4'° C., the temperature of the printing head is maintained at the desired printing head temperature β1° C. with turning ON and OFF the heating heater.

For example, when the controlled temperature of the fluid is α4'° C., and if the heating heater is not driven, the temperature of the printing head H4 becomes β1'° C. for balance of the heat accumulation amount per unit period of the printing head and the amount of heat to be removed in the unit period by the fluid flowing in the fluid passage provided in contact with the printing head and controlled at the temperature of α4'° C. In contrast to this, by providing auxiliary heat amount by additionally driving the heating heater, the temperature of the printing head can be elevated to β1° C.

As shown by the solid line of the graph, in the range of the controlled temperature of the fluid lower than α4'° C., the temperature of the printing head becomes lower than β1° C. At this time, the value of α4° C. is differentiated from heating performance of the heating heater. Namely, the heating heater having greater heating performance may elevate the temperature of the printing head to β1° C. in the lower controlled temperature of the fluid.

Figure 13B:
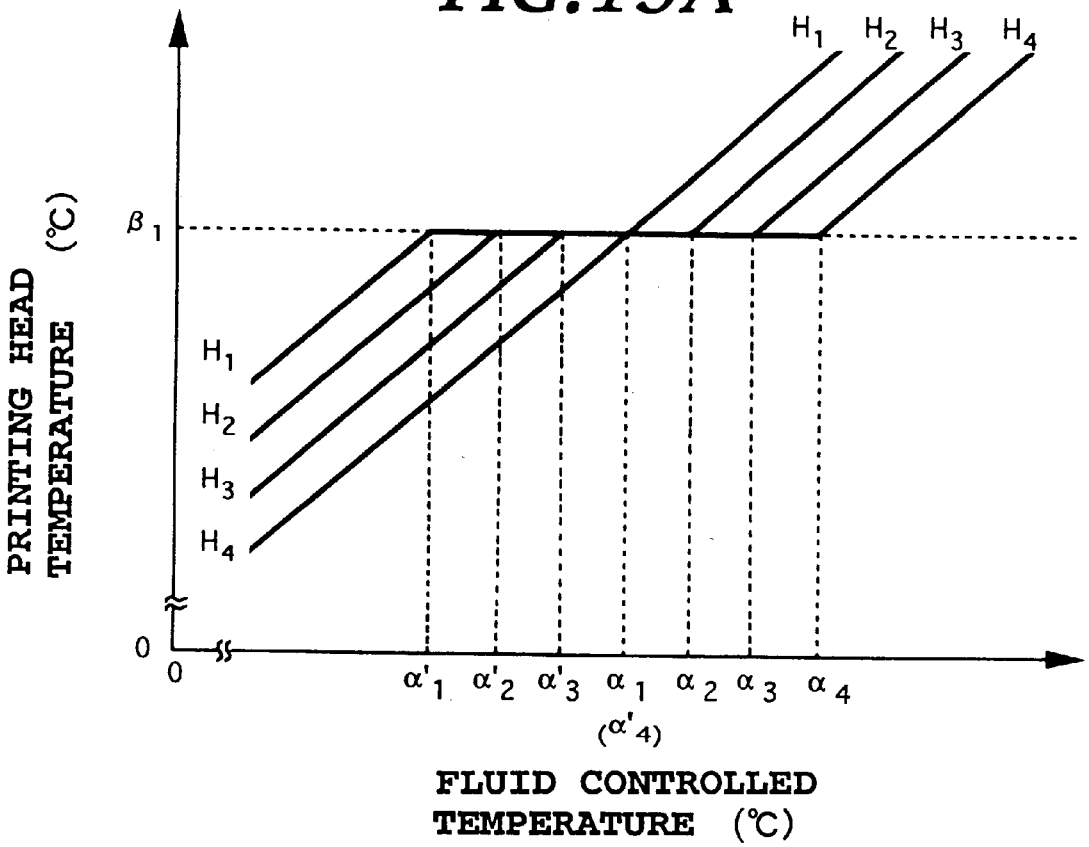

Graph in FIG. 13B shows a relationship between the controlled temperatures of the fluid and the temperatures at which the respective printing heads H1, H2, H3 and H4 become stable under respective of the controlled temperatures of the fluid. Each of printing heads H1, H2, H3 and H4 in FIG. 12B has different heat transmission performance and heat radiation performance and is provided with a heating heater having heating capacity to heat the head so as to make $\alpha 4'$° C. of FIG. 13A to correspond to $\alpha 1$° C. of FIG. 12B. The graph shows that by driving the heating heater having the capacity as set forth above, if the temperature of the fluid is controlled at $\alpha 1$° C., the temperatures of the printing heads H1 to H4 respectively having individual difference can be maintained at the desired temperature $\beta 1$° C.

Similarly, control is performed by turning the heating heater ON for heating while the temperature of the printing head is lower than or equal to the desired temperature $\beta 1$° C., and by turning the heating heater OFF while the temperature of the printing head is higher than or equal to $\beta 1$° C. for controlling auxiliary heat to the printing head. By this control, it becomes possible to provide the printing apparatus which can stably perform printing operation at the stable desired temperature against variation of the environmental temperature surrounding the apparatus.

As set forth above, the ink-jet printing apparatus in the shown embodiment includes means for making the heat accumulation amount of the printing head in the unit period constant, means for continuously supplying fluid into the fluid passage provided in contact with the printing head to make the heat amount to be removed from the printing head per unit period constant, and control means for controlling the temperature of the fluid at the desired temperature. Also, the heating heater is provided with the printing head for providing auxiliary heat. By this, the temperature of the printing head can be maintained stable without being affected by the environmental temperature or by individual difference between the printing heads, at the specific temperature, at which the desired printing quality and the printing density are obtained.

It should be noted that, in the foregoing embodiments, discussion has been given with taking the printing head of the serial type ink-jet printing apparatus employed in the ink-jet printing apparatus, particularly the textile printing apparatus, as temperature control of the printing head which generates a large amount of heat, application of the present invention is not limited to those illustrated. The present invention is widely applicable for a liquid ejection apparatus which requires temperature control irrespective of size of the apparatus, and number and shape of the printing head.

Figure 15:
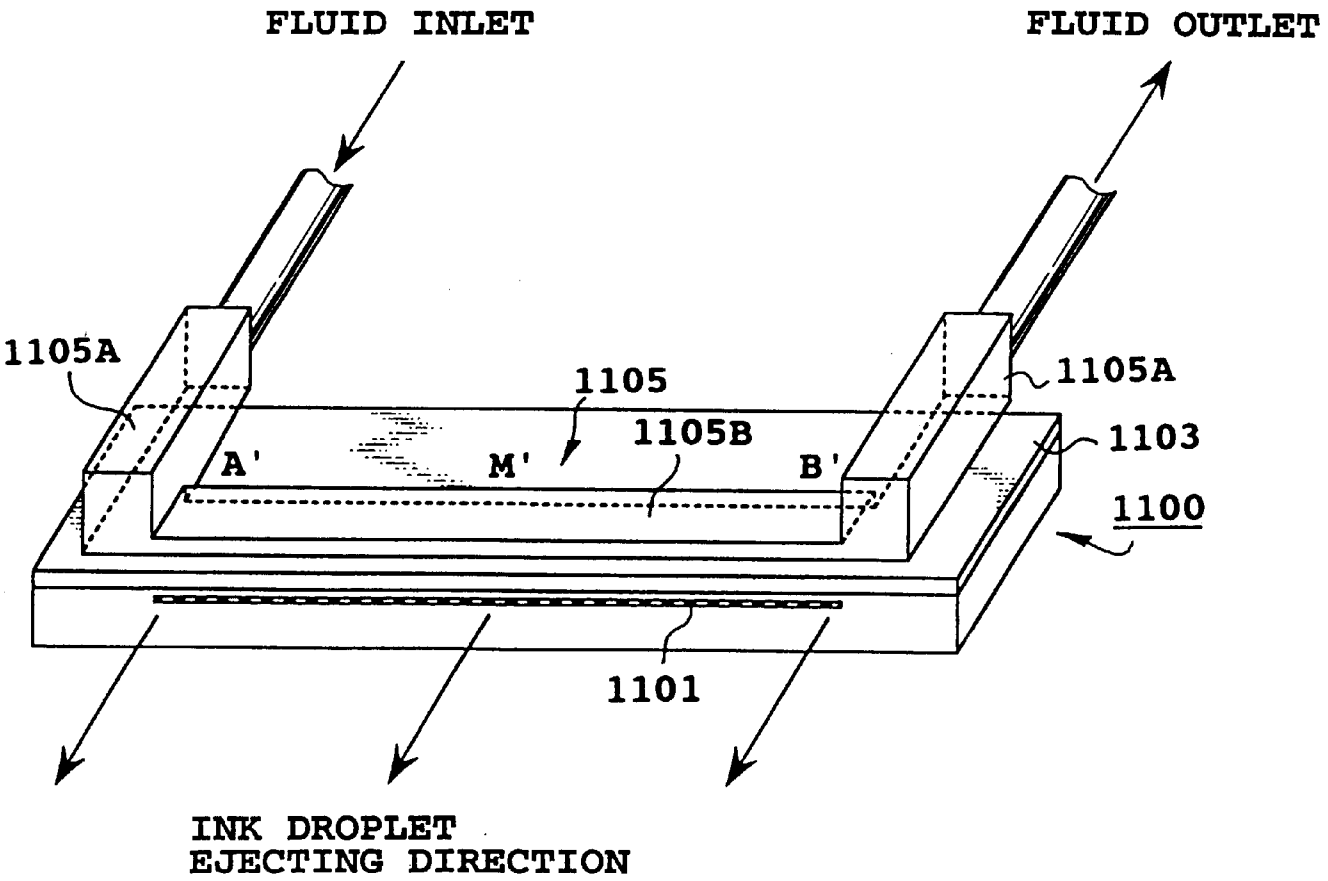
FIG. 15 is a diagrammatic perspective view showing one example of the printing head having a water tube for cooling water.

FIG. 15 is a diagrammatic perspective view for again showing the construction of a printing head and a passage for flowing cooling water.

Figure 14:
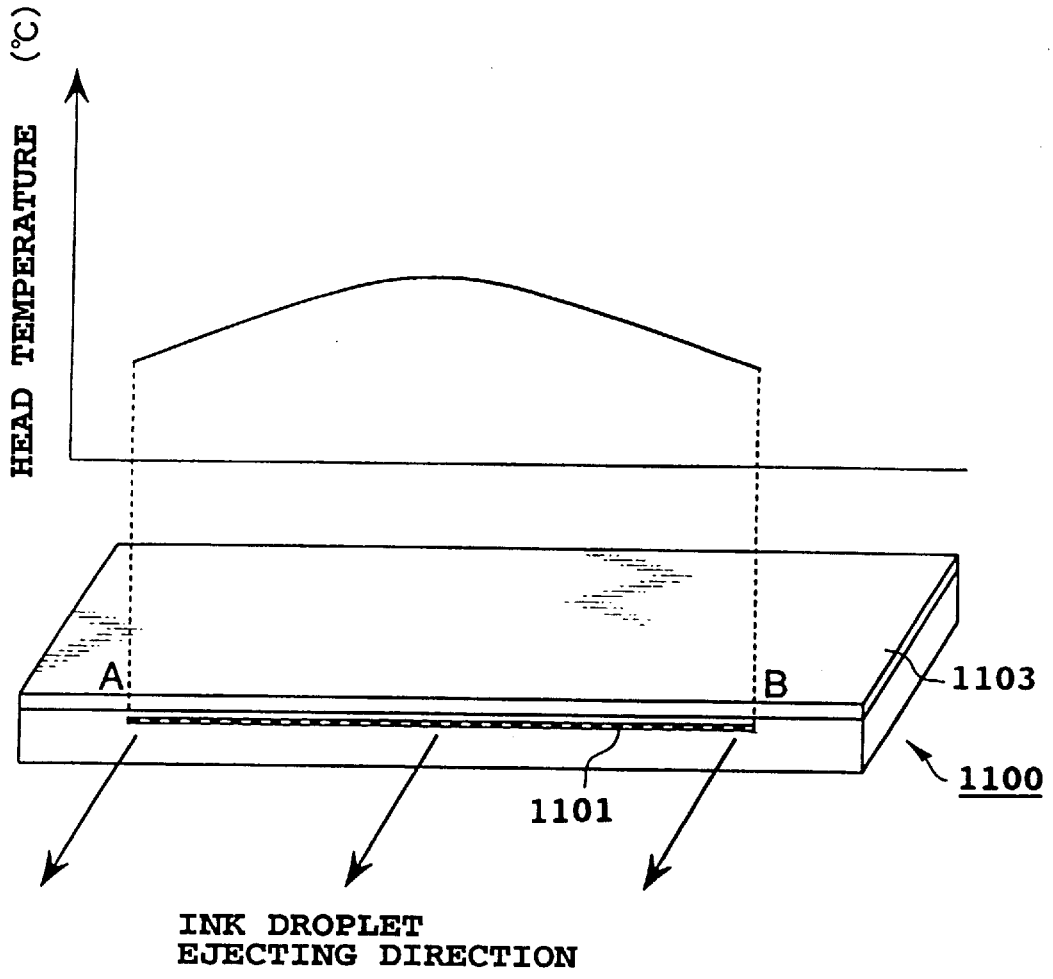
FIG. 14 is an illustration for explaining temperature distribution along an array of ejection openings of the ink-jet printing head.

In FIG. 15, a water tube 1105 for flowing cooling water on one surface of a base plate 1103 forms a constructional component of an ink-jet head 1100. The water tube 1105 is constituted of a portion 1105B extending along an aligning direction of ejection openings 1101 in the head 1100 and a portion 1105A provided at both end portions of the base plate 1103 and extending in a perpendicular direction to the aligning direction of the ejection openings. Respective portions have uniform sectional areas with respect to a flow direction of the cooling water. The cooling water is managed within a predetermined temperature range by a cooling water supply portion (not shown), and flows in contact with the base plate during flowing in the water tube 1105. By this, heat of the base plate is discharged to the cooling water, and the ink temperature in the ink passage and so forth is maintained within the constant temperature range in the condition where temperature distribution is reduced, as shown in FIG. 14.

Figure 16A:
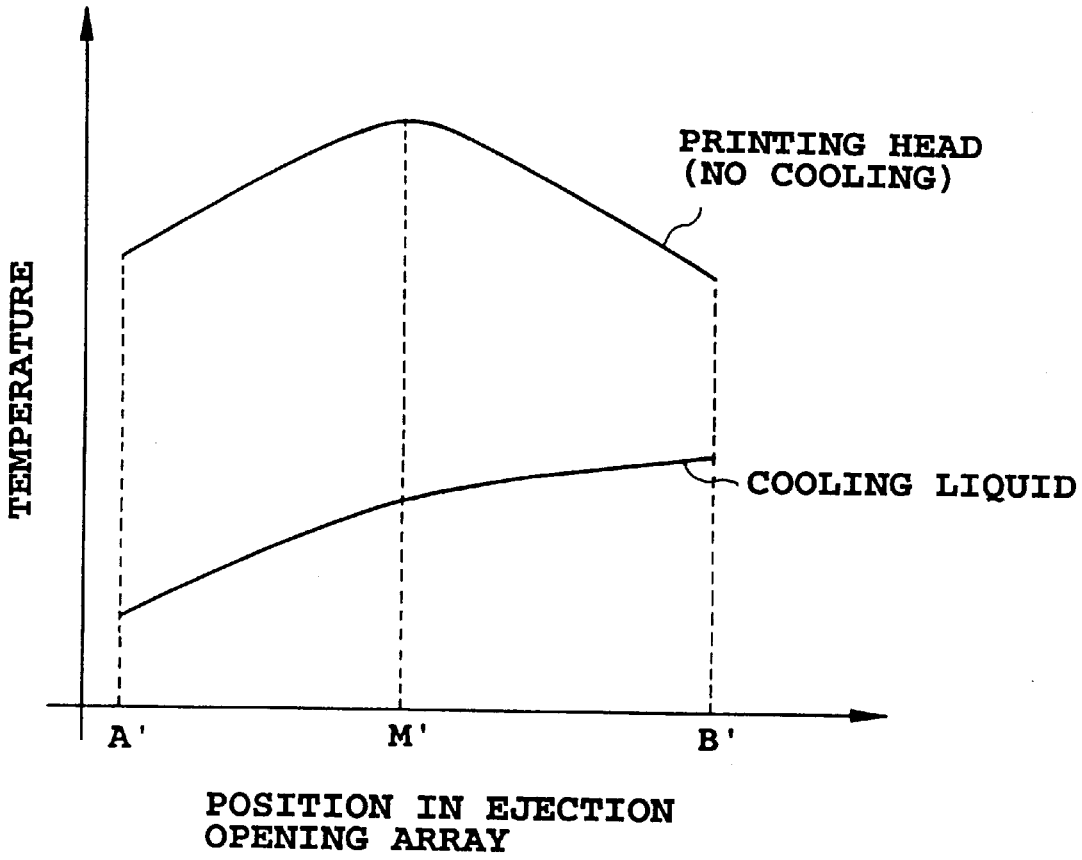
FIGS. 16A and 16B are illustrations for explaining temperature distribution of the printing head of FIG. 15 and effect of the cooling water thereto.
Figure 16B:
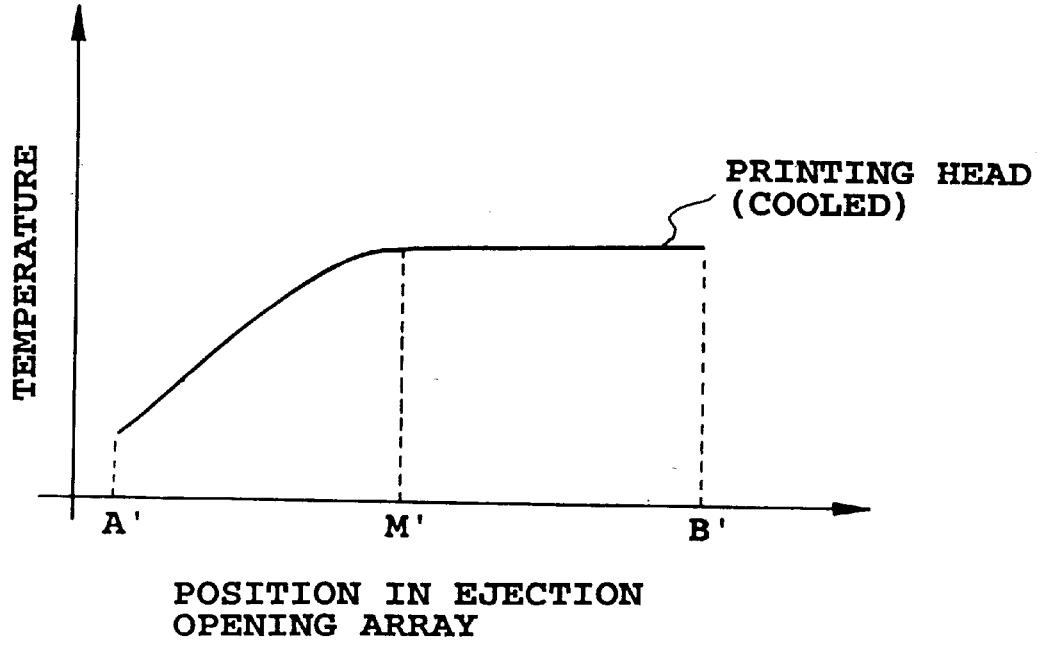

However, in temperature control by the construction shown in FIG. 15, it is possible to newly cause temperature distribution due to the cooling water. FIGS. 16A and 16B are illustrations for explaining this phenomenon.

Namely, as shown in FIG. 16A, the temperature distribution in the aligning direction of the ejection openings in the printing head in the case where the cooling water is not employed has the highest temperature at the center portion M' in the ejection opening array (see FIG. 15). This is as discussed with regard to FIG. 14.

When the cooling water is circulated by the construction shown in FIG. 15 for the printing head which may cause temperature distribution, the cooling water temperature is gradually elevated by the heat discharged from the base plate during flow through the portion 1105B of the water tube 1105.

In such a case, in the resulting temperature distribution to be caused in the printing head, the temperature of the head is made uniform only on the downstream side of the cooling water, as shown in FIG. 16B, causing a large difference to the temperature on the upstream side. In such a case, a significant difference of density can be caused in the printed image or so forth, as set forth above.

Discussion will be given hereinafter with respect to the construction of the water tube which can provide solution for such problems.

[Fifth Embodiment]

Figure 17:
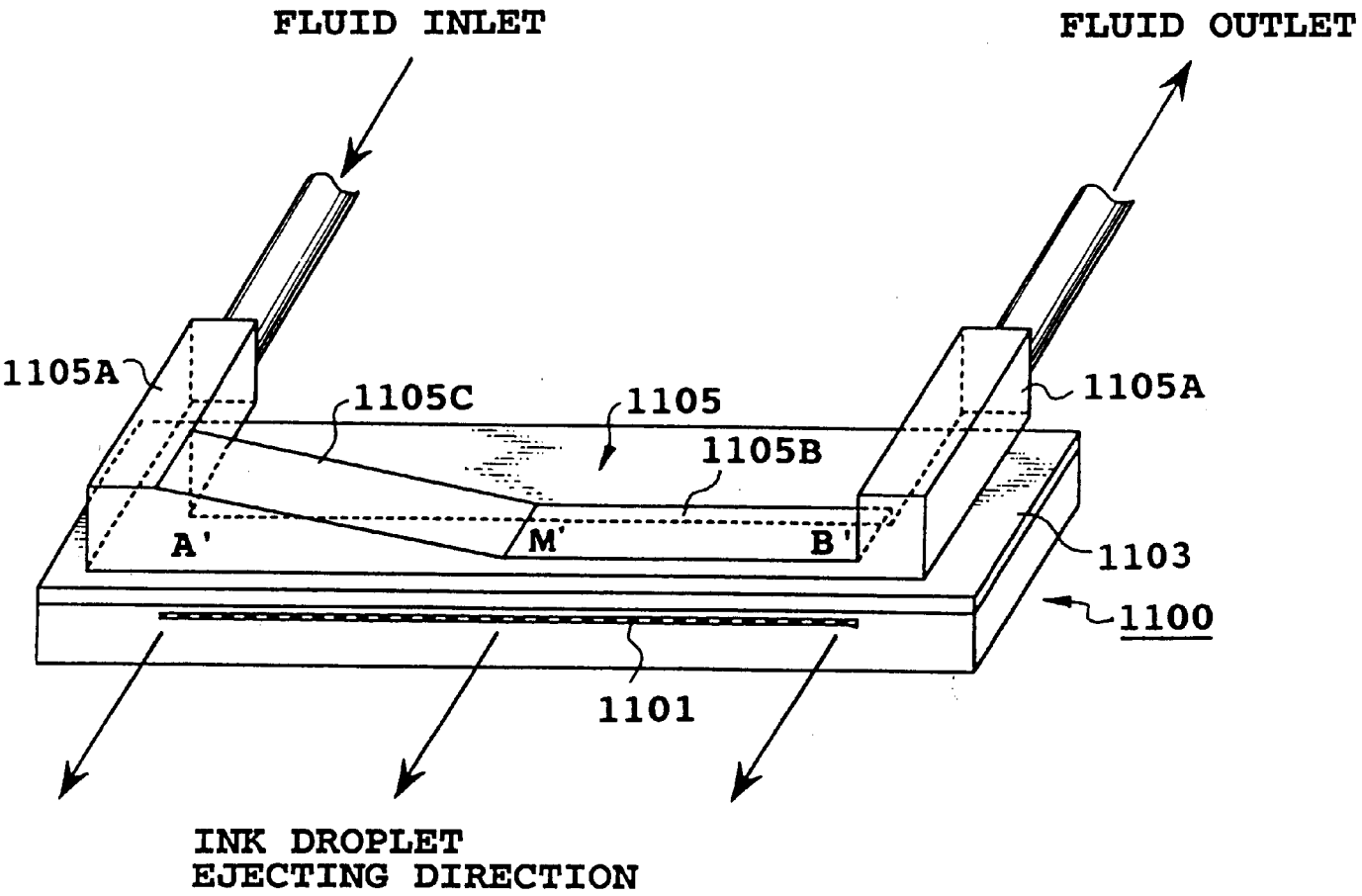
FIG. 17 is a diagrammatic perspective view showing one example of a water tube structure of the printing head according to the invention.

FIG. 17 is a diagrammatic perspective view showing a water tube structure for cooling water in the fifth embodiment of the present invention. It should be noted that like elements to those in FIG. 15 will be identified by like reference numerals and discussion therefor will be neglected for keeping the disclosure simple enough to facilitate clear understanding of the invention.

The shown embodiment of the water tube is divided into two portions 1105B and 1105C across the center point M' in the cross-sectional configuration in the portion extending along the array of the ejection openings 1101. Similarly to those shown in FIG. 15, the portion 1105B has a uniform cross-sectional area with respect to the flow direction of the cooling water. In contrast to this, the cross-sectional area of the portion 1105C is decreased at a constant ratio toward the downstream side. The cross-sectional areas of the portions 1105C and 1105B becomes coincident with each other at the center point M'.

As set forth above, with the construction of the shown embodiment, the smaller cross-sectional area in the portions 1105C and 1105B of the water tube results in higher flow velocity of the cooling water. Accordingly, the amount of heat to be removed from the base plate 1100 within the unit period by the cooling water flowing through the water tube 1105 becomes greater at portion having the smaller cross-sectional area. In more practical terms, in the portion 1105C of the water tube, since the cross sectional area is gradually reduced toward the downstream side with respect to flow of the cooling water, the amount of heat to be removed from the base plate 1103 within the unit period by the cooling water is gradually increased. On the other hand, in the portion 1105B, the amount of heat to be removed by the cooling water within the unit period becomes constant.

Figure 18:
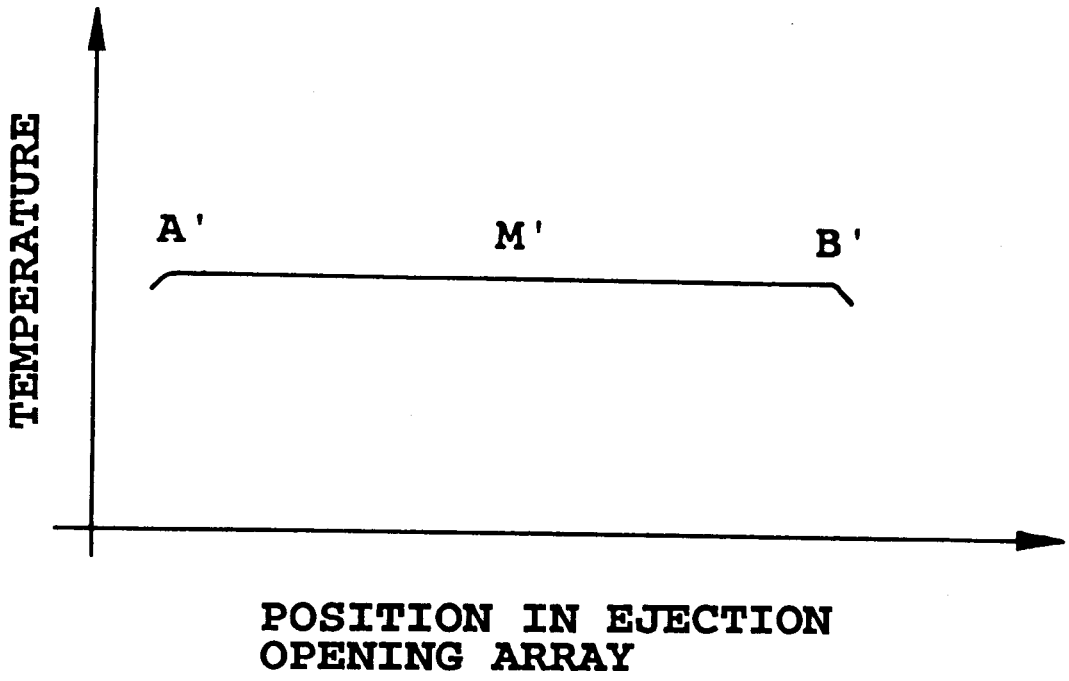
FIG. 18 is an illustration showing an effect of the temperature control of the present invention.

With the construction set forth above, in the printing head which can cause temperature distribution shown in FIG. 16A, at first, with respect to the head temperature which can be elevated gradually from the portion A' to M', the flow velocity of the cooling water in the portion 1105C of the water tube gradually increases so that the head temperature becomes uniform. On the other hand, in the range of M' to B', the head temperature can be gradually lowered, but by the fact that the flow velocity of the cooling water is constant and by the effect that the cooling water itself elevates in temperature, the head temperature is similarly made uniform. As a result, the temperature distribution shown in FIG. 18 throughout the printing head can be obtained.

[Sixth Embodiment]

Figure 19:
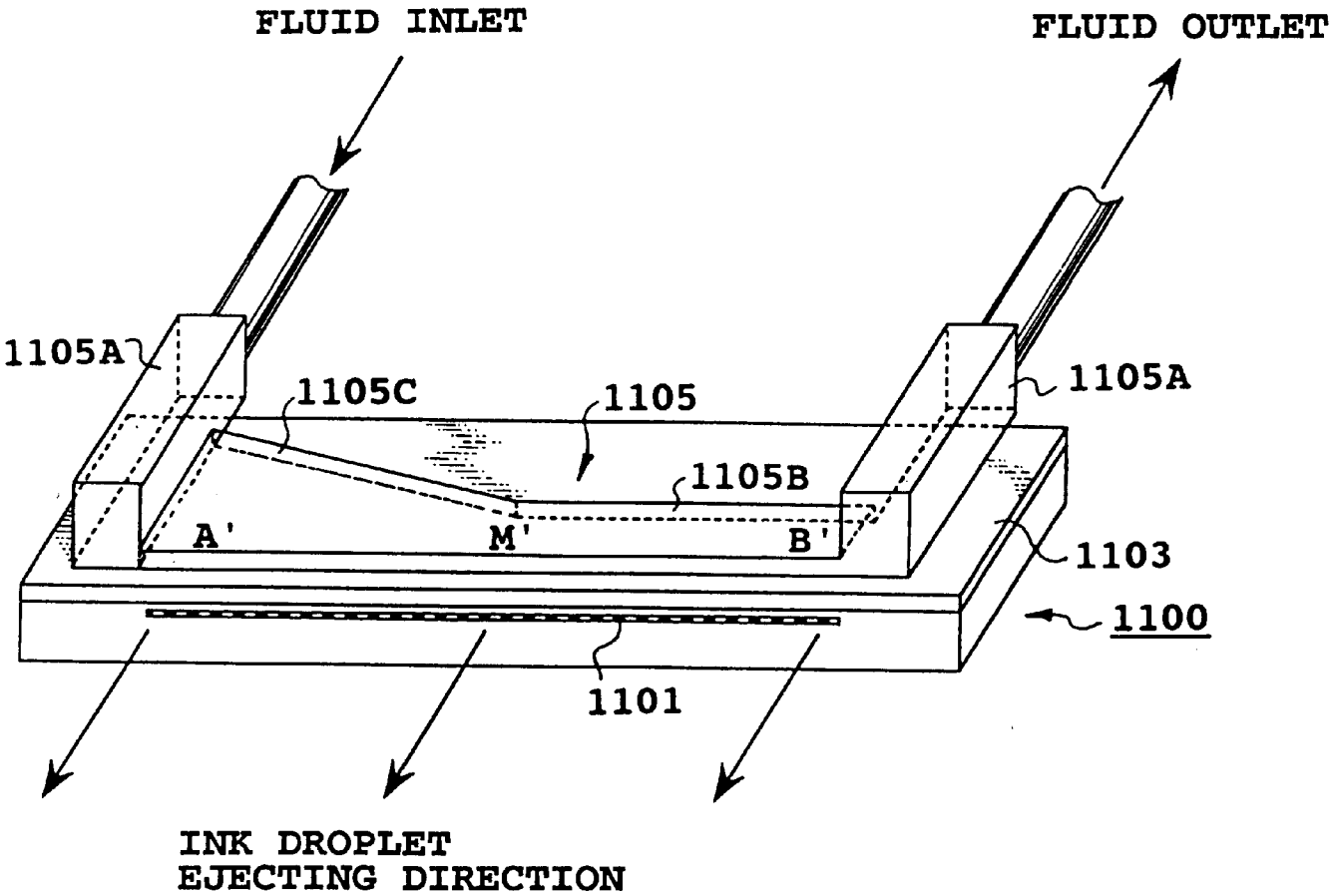
FIG. 19 is a diagrammatic perspective view showing another example of the water tube structure of the printing head of the present invention.

FIG. 19 is a diagrammatic perspective view showing a water tube construction for cooling water in the sixth embodiment of the present invention.

In the shown embodiment, the configuration of the portion 1105C where the cross sectional area of the water tube is varied, is varied in the direction along the surface of the base plate 1103, By this, similarly to that discussed with respect to the fifth embodiment, the temperature distribution along the aligning direction of the ejection openings of the head 1100 can be made uniform. Associating with this, the portion varying the cross section is varied along the surface of the base plate for reducing flow resistance of the cooling water and whereby the required performance for the pump or so forth as a driving power source for circulating the cooling water can be made smaller.

In the shown embodiment, the area, in which the cooling water contacts with the base plate 1103, can be expanded to increase a heat discharging area. Therefore, it is desirable to determine a variation rate of the cross sectional area with taking heat discharging efficiency by increasing of the heat discharging area. However, the effect of the heat discharge by the flow velocity is more prominent than that of the heat discharge by increasing of the area.

Figure 20:
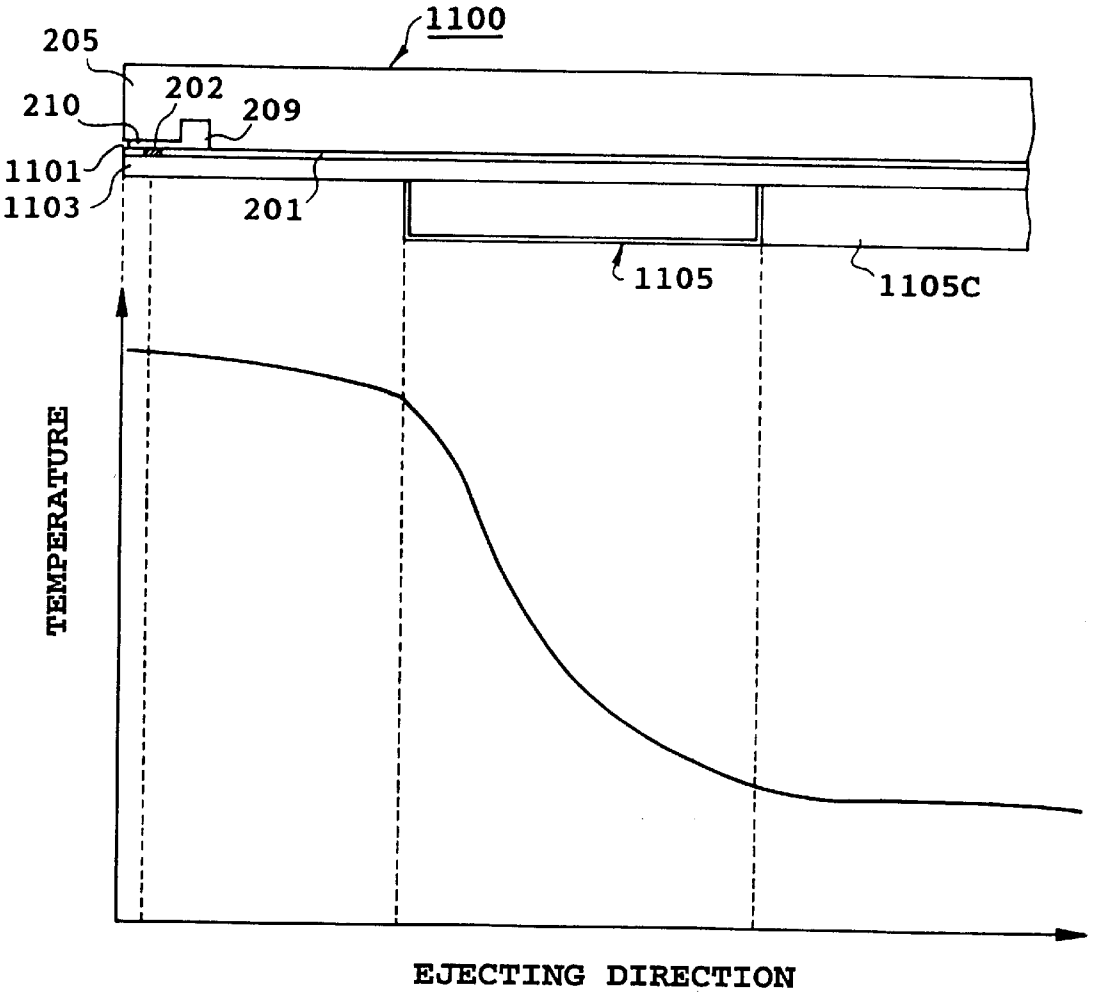
FIG. 20 is an illustration showing a section of the ink-jet head and the water tube and temperature distribution of FIG. 19.

FIG. 20 is an illustration showing a longitudinal section in the ejecting direction at one ejection opening in the printing head shown in FIG. 19 and a temperature distribution of the head along the ejecting direction.

As shown, the water tube 1105 is located at the back of the electrothermal transducer 202 as the heat generation source. Accordingly, the cooling water may absorb the heat generated in the foregoing heat source via the base plate 1103 formed of aluminum or so forth.

[Seventh Embodiment]

Figure 21:
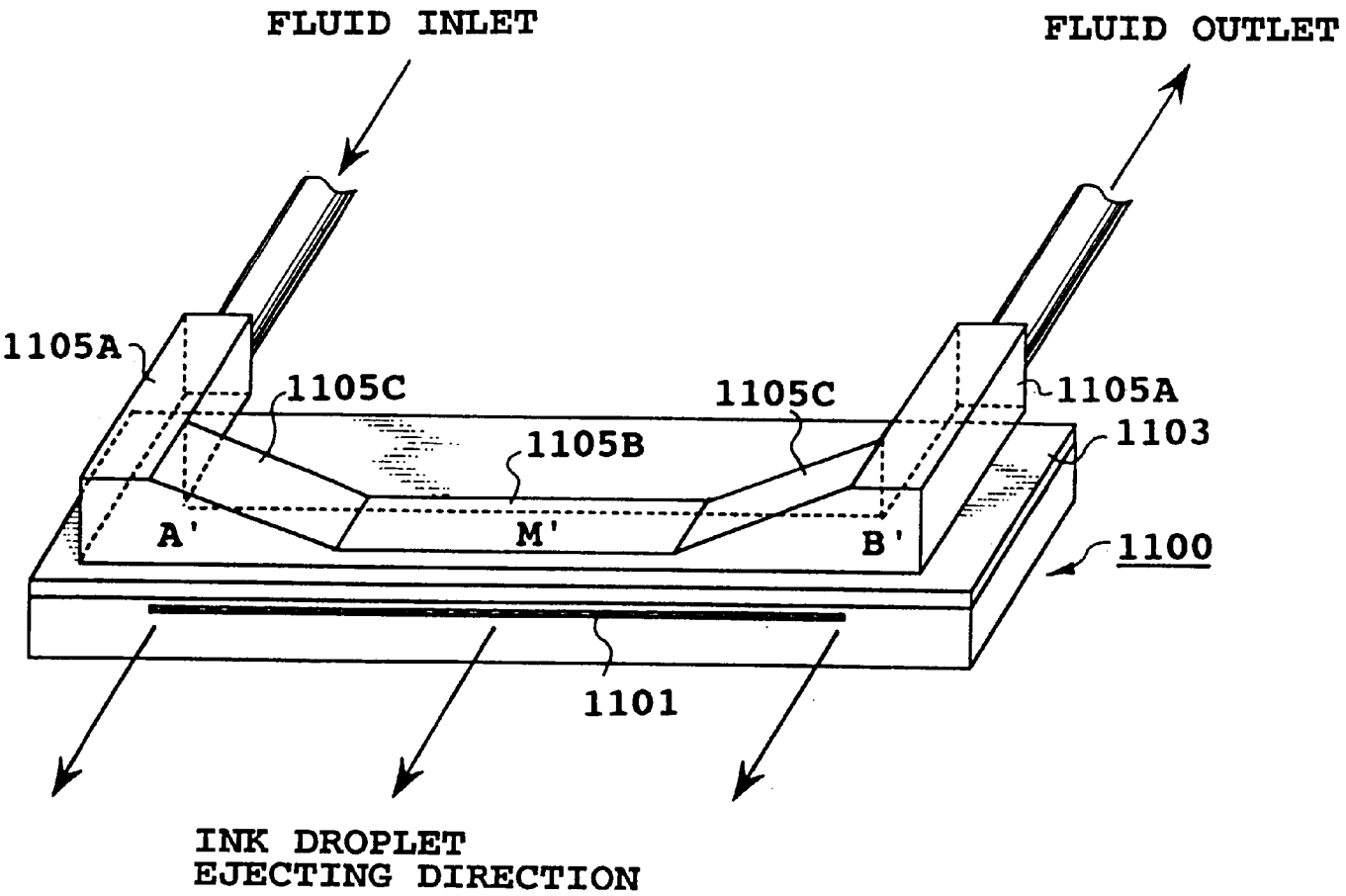
FIG. 21 is a diagrammatic perspective view showing a further example of the water tube structure of the printing head of the present invention.

FIG. 21 is a diagrammatic perspective view showing a water tube construction in the seventh embodiment of the present invention.

In the shown embodiment, the portion 1105c varying the cross sectional area of the water tube is provided at both ends of the ejection opening array as shown in FIG. 21. Thus, the head temperature can be made uniform even when the flow velocity is made gradually smaller by varying the sectional area even on the downstream side, as shown in FIG. 18A.

Namely, when the flow velocity of the cooling water flowing in the water tube 1105 is relatively large or when the heat generation amount of the printing head is small, the effect of the heat radiation relying on the flow velocity is prominent to make the effect of self elevation of temperature in the cooling water ignorable. Therefore, when the temperature distribution of the printing head shown in FIG. 16A is caused, the temperature at the central portion where the temperature becomes highest, otherwise, can be lowered relatively by making the flow velocity at the center portion of the printing head high so as to make the temperature distribution uniform.

It should be noted that, in respective embodiments set forth above, the temperature distribution of the printing head is of course different depending upon heat capacity of the cooling water and heat generation amount of the printing head or so forth. In general, a head having smaller heat capacity of the cooling water, smaller flow velocity, and further, larger heat generation amount, results in greater distribution difference. On the other hand, the heat amount to be removed from the printing head by the cooling water is also influenced by the temperature difference between the cooling water and the head.

On the other hand, the present invention is characterized by varying the flow velocity distribution of the cooling water within the water tube depending upon the temperature distribution of the printing head. Any constructions which achieve this is included in the scope of the present invention.

Furthermore, in the foregoing embodiments, discussion has been made in terms of the ink-jet type printing head utilizing thermal energy, but it is clear that the present invention is applicable for heads causing temperature distribution in individual head, such as other type ink-jet head, thermal transfer type printing head and so forth.

Although the invention has been illustrated and described with respect to exemplary embodiments thereof, it should be understood by those skilled in the art that the foregoing and various other changes, omissions and additions may be made therein and thereto, without departing from the spirit and scope of the present invention. Therefore, the present invention should not be understood as limited to the specific embodiment set out above but to include all possible embodiments which can be embodied within a scope encompassed and equivalents thereof with respect to the feature set out in the appended claims.

What is claimed is:

1. A printing apparatus having a printing head performing printing by ejecting a liquid by application of thermal energy to the liquid, comprising:

a fluid passage provided in contact with said printing head;

fluid supply means for supplying a fluid into said fluid passage;

control means for controlling a temperature of said fluid to be supplied by said fluid supply means within a predetermined temperature range; and temperature detecting means for detecting a temperature of the printing head, wherein said control means controls the temperature of said fluid within the predetermined temperature range based on a detected temperature from said temperature detecting means.

2. A printing apparatus as claimed in claim 1, wherein said fluid supply means continuously circulates said fluid within said fluid passage.

3. A printing apparatus as claimed in claim 1, wherein said fluid supply means sets flow velocity and a flow rate of the fluid in said fluid passage so that the temperature of the printing head is within the predetermined temperature range.

4. A printing apparatus as claimed in claim 1, wherein the predetermined temperature range of the fluid is set in a range capable of controlling a temperature of said printing head within the predetermined temperature range.

5. A printing apparatus as claimed in claim 1, wherein said printing head is an ink-jet printing head having an electrothermal transducer as a generating source of said thermal energy.

6. A printing apparatus as claimed in claim 1, wherein said fluid is water.

7. A printing apparatus as claimed in claim 1, wherein said printing head comprises a heater to generate thermal energy, ejection openings for ejecting ink and a base plate, and wherein said fluid passage is provided on said base plate of said printing head.

8. A printing apparatus having a printing head performing printing by ejecting a liquid by application of thermal energy to the liquid, comprising:

thermal energy applying means for applying thermal energy to said printing head to make a heat accumulation amount per unit period constant;

a fluid passage provided in contact with said printing head;

supply means for continuously supplying a predetermined amount of fluid into said fluid passage; and control means for controlling a temperature of the fluid to be supplied by said supply means to a predetermined temperature for making a heat value to be removed from said printing head within a unit period constant.

9. A printing apparatus as claimed in claim 8, further comprising temperature detecting means for detecting a temperature of said printing head, and said control means controls the temperature of the fluid to said predetermined temperature on the basis of a detected temperature from said temperature detecting means.

10. A printing apparatus as claimed in claim 8, wherein said printing head includes an electrothermal transducer as a generating source of said thermal energy for ejecting said liquid, and said thermal energy applying means drives said electrothermal transducer.

11. A printing apparatus as claimed in claim 8, wherein said printing head comprises a heater to generate thermal energy, ejection openings for ejecting ink and a base plate, and wherein said fluid passage is provided on said base plate of said printing head.

12. A printing apparatus having a plurality of printing heads performing printing by ejecting liquid by application of thermal energy to the liquid, comprising:

thermal energy applying means for applying thermal energy to each of said printing heads so as to make respective heat accumulation amounts per unit period a predetermined amount;

fluid passages provided in contact with said printing heads, respectively;

supply means for continuously supplying a predetermined amount of fluid into each of said fluid passages; and control means for controlling a temperature of the respective fluids to be supplied by said supply means to a predetermined temperature so as to make a quantity of heat to be removed from said respective printing heads within a unit period a predetermined amount.

13. A printing apparatus as claimed in claim 12, which further comprises temperature detecting means for detecting a temperature of each of said printing heads, and said control means controls the temperature of each of the fluids to said predetermined temperature on the basis of detected temperatures from said temperature detecting means.

14. A printing apparatus as claimed in claim 12, wherein each of said printing heads includes an electrothermal transducer as a generating source of thermal energy for ejecting said liquid, and said thermal energy applying means drives said electrothermal transducer.

15. A printing apparatus as claimed in claim 13, further comprising an auxiliary heater for auxiliarily heating respective printing heads, and said control means controls the temperature of a printing head having a temperature lower than a given controlled temperature of said fluid to said predetermined temperature by driving said auxiliary heater for the printing head based on each detected temperature from said temperature detecting means.

16. A printing apparatus as claimed in claim 13, further comprising an auxiliary heater for auxiliarily heating respective printing heads, and said control means controls the temperature of each of the fluids to a constant temperature and controls the temperature of a printing head having a temperature lower than a given controlled temperature of said fluid to said predetermined temperature by driving said auxiliary heater for the printing head based on each detected temperature from said temperature detecting means.

17. A printing apparatus as claimed in claim 12, wherein each printing head comprises a heater to generate thermal energy, ejection openings for ejecting ink and a base plate, and wherein said fluid passage is provided on said base plate of each printing head.

18. A printing apparatus having a printing head for performing printing on a printing medium, comprising:

a flow passage portion provided in said printing head for flow of a liquid in a flow direction to cause a distribution in temperature in said printing head; and flow generating means for generating a distribution of flow velocity of the liquid flowing in said flow passage portion depending upon said distribution in temperature, wherein said printing head includes a plurality of printing elements aligned in an aligning direction, said flow direction causing said distribution in temperature in the aligning direction of said plurality of printing elements, said flow passage portion being provided over a position where said plurality of printing elements are aligned for removing heat generated by said plurality of printing elements by flowing of the liquid in the aligning direction of said plurality of printing elements, and said flow passage portion has an inlet at one end in the aligning direction of said plurality of printing elements and an outlet at another end in the aligning direction of said plurality of printing elements, and wherein said flow generating means generates the distribution of flow velocity of the liquid such that the flow velocity at the outlet is higher than the flow velocity at the inlet.

19. A printing apparatus as claimed in claim 18, wherein said flow generating means causes the distribution of flow velocity by differentiating a cross-sectional area with respect to the flow direction of said flow passage portion.

20. A printing apparatus as claimed in claim 19, wherein said cross-sectional area is decreased at a constant ratio on the upstream side of said flow passage portion.

21. A printing apparatus as claimed in claim 19, wherein said cross-sectional area is decreased and increased at constant ratio on upstream side and downstream side of said flow passage portion, respectively.

22. A printing apparatus as claimed in claim 18, wherein said printing head generates a bubble in ink by application of thermal energy and ejects the ink by generation of the bubble.

23. A printing apparatus as claimed in claim 22, wherein ejection openings for ejecting ink of said printing head form said printing elements.

24. An ink-jet head having a plurality of ink ejection openings and a printing element array comprised of a plurality of printing elements generating thermal energy for ejecting ink, comprising:

a flow passage portion provided for flow of liquid in a flow direction along a direction of alignment of said plurality of printing elements, said flow passage portion being provided over a position where said plurality of printing elements are aligned for removing heat generated by said plurality of printing elements by flowing of the liquid in the aligning direction of said plurality of printing elements, a cross-sectional area of said flow passage portion being differentiated in the flow direction, wherein said flow passage portion has an inlet at one end in the aligning direction of said plurality of printing elements and an outlet at another end in the aligning direction of said plurality of printing elements and a flow velocity at the outlet is higher than the flow velocity at the inlet.

25. A method of controlling temperature of a printing head of a printing apparatus, said printing head performing ejection of ink by application of thermal energy to the ink, said method comprising the steps of:

controlling a temperature of a fluid for cooling said printing head; and supplying the fluid, having temperature controlled in said controlling step, to a fluid passage provided in contact with the printing head, wherein in said controlling step the temperature of the fluid is controlled to a predetermined temperature for making a heat value to be removed from the printing head within a unit period constant.

* * * * *

UNITED STATES PATENT AND TRADEMARK OFFICE

CERTIFICATE OF CORRECTION

PATENT NO. : 6,074,035

DATED : June 13, 2000

INVENTOR(S) : IRIZAWA ET AL.

It is certified that error appears in the above-identified patent and that said Letters Patent is hereby corrected as shown below:

[75] Inventors:
"Oizumi-machi;" should read --Tokyo;--.

[56] References Cited:
FOREIGN PATENT DOCUMENTS, "4047948" should read --4-47948--.

COLUMN 4:
Line 30, "a" should be deleted.

COLUMN 6:
Line 17, "FIG. 1b" should read --FIG. 1B--.
Line 44, "glide" should read --slide--.

COLUMN 8:
Line 61, "has" should read --has a--.

COLUMN 9:
Line 17, "flows directly flow" should read --directly flows--.

COLUMN 11:
Line 3, "for" should be deleted.

UNITED STATES PATENT AND TRADEMARK OFFICE

CERTIFICATE OF CORRECTION

PATENT NO. : 6,074,035

DATED : June 13, 2000

INVENTOR(S) : IRIZAWA ET AL.

It is certified that error appears in the above-identified patent and that said Letters Patent is hereby corrected as shown below:

COLUMN 14:
Line 5, "for" should read --to--.
Line 33, "number" should read --numeral--.

COLUMN 15:
Line 6, "with" (second occurrence) should read --thereby--.

COLUMN 17:
Line 50, "for" should be deleted.

COLUMN 18:
Line 47, "becomes" should read --become--.
Line 55, "portion" should read --portions--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*